US007073894B2

(12) United States Patent
Isono et al.

(10) Patent No.: US 7,073,894 B2
(45) Date of Patent: Jul. 11, 2006

(54) INK JET PRINTER HEAD

(75) Inventors: Jun Isono, Nagoya (JP); Atsushi Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 136 days.

(21) Appl. No.: 10/777,625

(22) Filed: Feb. 12, 2004

(65) Prior Publication Data

US 2004/0160494 A1 Aug. 19, 2004

(30) Foreign Application Priority Data

Feb. 13, 2003 (JP) ..... 2003-035690
Feb. 13, 2003 (JP) ..... 2003-035691
Mar. 11, 2003 (JP) ..... 2003-065100
Aug. 20, 2003 (JP) ..... 2003-296295

(51) Int. Cl.
*B41J 2/045* (2006.01)

(52) U.S. Cl. ..... 347/68; 347/71

(58) Field of Classification Search ..... 347/68, 347/70–72, 43, 47, 50
See application file for complete search history.

(56) References Cited

U.S. PATENT DOCUMENTS 6,142,615 A * 11/2000 Qiu et al. ..... 347/70
2001/0020968 A1 9/2001 Isono et al.
2002/0003560 A1 1/2002 Isono et al.
2002/0024567 A1* 2/2002 Takagi ..... 347/72

FOREIGN PATENT DOCUMENTS

| | | |
|---|---|---|
| JP | A-6-316064 | 11/1994 |
| JP | A-9-29977 | 2/1997 |
| JP | A-2001-246744 | 9/2001 |
| JP | A-2002-19102 | 1/2002 |
| JP | A-2002-36544 | 2/2002 |
| JP | A-2002-59547 | 2/2002 |

* cited by examiner

*Primary Examiner*—Shih-Wen Hsieh
(74) *Attorney, Agent, or Firm*—Reed Smith LLP

(57) ABSTRACT

An ink jet printer head includes a cavity unit and a piezoelectric actuator that is bonded to the cavity unit. The piezoelectric actuator includes a top sheet on which external pads are formed in arrays, at an appropriate pitch in each array, in a direction parallel to a direction in which nozzles are formed in arrays in the cavity unit. The external pads are electrically connected to respective individual electrodes via respective internal leads, and also to a flat cable. Each of the external pads is formed at a position right above a partition wall that separates two pressure chambers from each other in the cavity unit. Therefore, when the piezoelectric actuator is bonded to the cavity unit, the external pads of the actuator can be strongly pressed against the partition walls of the cavity unit, so that the actuator can be strongly bonded to the cavity unit and the amount of leakage of ink from the pressure chambers can be minimized. In addition, since the pressing force is not directly applied to the pressure chambers each as a vacant space, the pressure chambers can be prevented from being deformed and the piezoelectric actuator can be prevented from being cracked.

40 Claims, 23 Drawing Sheets

INK JET PRINTER HEAD

BACKGROUND OF THE INVENTION

1. Field of the Invention

The present invention relates to an ink jet printer head and particularly to such an ink jet printer head which includes a cavity unit having a plurality of pressure chambers, and a piezoelectric actuator fixed to the cavity unit.

2. Discussion of Related Art

Patent Document 1 (i.e., Japanese Patent Publication Document No. 2001-246744 or its corresponding U.S. Patent Publication Document No. 2001-020968), Patent Document 2 (i.e., Japanese Patent Publication Document No. 2002-019102 or its corresponding U.S. Patent Publication Document No. 2002-003560), Patent Document 3 (i.e., Japanese Patent Publication Document No. 2002-059547 or its corresponding U.S. Patent Publication Document No. 2002-024567), or Patent Document 4 (i.e., Japanese Patent Publication Document No. 2002-036544 or its corresponding U.S. Patent Publication Document No. 2002-003560) discloses an on-demand ink jet printer head. The disclosed printer head employs a cavity unit that consists of a plurality of sheet members stacked on each other and has an ink channel. The sheet members include a nozzle sheet having a plurality of nozzles; a base sheet having a plurality of pressure chambers communicating with the plurality of nozzles, respectively; and a manifold sheet having a manifold chamber as a common ink chamber that communicate, at one end thereof, with an ink supply source and, at other ends, with the pressure chambers. The disclosed printer head additionally employs a piezoelectric actuator including a plurality of piezoelectric ceramic sheets and a plurality of internal electrodes that are alternately stacked on each other. The plurality of electrodes include a plurality of common electrodes and a plurality of individual-electrode layers that are alternate with each other in the direction of alternate stacking of the piezoelectric sheets and the electrodes. Each of the individual-electrode layers includes a plurality of individual electrodes that are separate from each other. Thus, the piezoelectric actuator includes a plurality of active portions each of which includes respective one individual electrodes of the individual-electrode layers, respective portions of the common electrodes that are aligned with those respective individual electrodes in the stacking direction, and respective portions of the piezoelectric sheets that are aligned with those respective individual electrodes in the same direction. The piezoelectric actuator is bonded to the cavity unit, such that each of the active portions of the piezoelectric actuator is aligned, in its plan view, with a corresponding one of the pressure chambers of the cavity unit.

The piezoelectric actuator has, on an upper surface of an uppermost layer thereof, a plurality of individual surface electrodes that are electrically connected, respectively, to the plurality of individual electrodes of each of the individual-electrode layers, and a common surface electrode that is electrically connected to each of the common electrodes. Each of the individual surface electrodes, and the common surface electrode are used to apply an electric voltage to a corresponding one of the active portions of the piezoelectric actuator. The individual and common surface electrodes are bonded, with, e.g., solder, to respective connection terminals of a cable member, such as a flat cable, so that control signals are supplied from an external control device to the piezoelectric actuator.

In the disclosed printer head, however, each of the individual surface electrodes is located right above an end portion of a corresponding one of the individual electrodes of each of the individual-electrode layers which end portion is extended in an outward direction away from a corresponding one of the pressure chambers. Thus, the individual surface electrodes are arranged in an array that is located outside, and is parallel to, an array in which the pressure chambers are arranged. The common surface electrode connected to each of the common electrodes is located near to one end of the array of individual surface electrodes.

Each of the individual and common surface electrodes projects from the upper surface of the piezoelectric actuator, by an amount equal to its thickness. Therefore, when the piezoelectric actuator is bonded with adhesive to the cavity unit while a pressing force is applied to the piezoelectric actuator, the pressing force is strengthened locally at the individual and common surface electrodes. More specifically described, the piezoelectric actuator is adhered to the cavity unit, sufficiently strongly at respective portions of the actuator that correspond to the vicinities of respective end portions of the pressure chambers where the respective end portions of the individual electrodes are extended, but insufficiently strongly at respective portions of the actuator that correspond to the vicinities of respective remaining portions of the pressure chambers. Thus, ink may leak from one of the pressure chambers into another pressure chamber.

In addition, since the respective end portions of the individual electrodes are extended in the respective outward directions away from the corresponding pressure chambers, the dimension of the piezoelectric actuator in the lengthwise direction of each of the pressure chambers needs to be increased for the purpose of locating the individual surface electrodes at the respective appropriate positions. Thus, both the piezoelectric actuator and the cavity unit cannot be downsized.

If the respective end portions of the individual electrodes that are extended in the respective outward directions away from the corresponding pressure chambers, are shortened to solve the above-identified problems, then other problems arise that the size of each of the active portions is adversely limited and that since an electrically conductive material connecting between the individual electrodes and the individual surface electrodes is located too near to the active portions, the operation of each of the active portions is adversely limited. Moreover, if the individual surface electrodes partly overlap, in the plan view of the piezoelectric actuator, the corresponding pressure chambers, then the above-indicated pressure force is applied to the pressure chambers, i.e., vacant spaces when the piezoelectric actuator is adhered to the cavity unit. Thus, cracks may occur to the piezoelectric sheets, or a sufficiently strong pressing force may not be applied to the piezoelectric actuator, or may not be uniformly distributed over the same. These problems may lead to a defect of the printer head that the piezoelectric actuator and the cavity unit are not sufficiently strongly bonded to each other.

Furthermore, since the pressing force applied to the piezoelectric actuator may change the original shape of each pressure chamber of the cavity unit, i.e., may change designed plan-view shape and/or cross-sectional area of the same, the printer head may not be able to enjoy its designed printing quality.

Meanwhile, a conventional ink jet printer apparatus includes, in addition to the above-described ink jet printer head, a carriage that carries the printer head forward and backward in a printing direction perpendicular to a feeding direction in which a recording sheet is fed, so that the printer head prints or records characters and/or symbols on the recording sheet in a widthwise direction thereof. The nozzles of the printer head are arranged in an array in a direction parallel to the feeding direction. Therefore, an area or length of the recording sheet over which the printer head can record characters and/or symbols when it is moved one time in the printing direction, is substantially equal to the length of the array of nozzles in the feeding direction. For example, in the case where the printer head has 72 nozzles that are arranged in a zigzag manner within one inch in the feeding direction, the printer head can record images, on the recording sheet, within an area or length of one inch in the feeding direction, when it is moved one time in the printing direction.

Recently, ink jet printers have been required to print at high speed and with high quality. Thus, the length of the array of nozzles is required to be increased up to, for example, 2 inches by increasing the number of nozzles in the feeding direction without changing the short regular interval at which the nozzles are arranged, i.e., dots are recorded. If the nozzles and the pressure chambers are formed using a laser or by etching in respective sheet members of the cavity unit that are metallic sheets or synthetic-resin-based sheets, the nozzles or the pressure chambers can be formed accurately at substantially the same interval as designed, irrespective of the total number thereof.

On the other hand, if a single piezoelectric actuator is prepared to have the same number of active portions as the number of the nozzles, it is needed to increase the length of the piezoelectric actuator, i.e., the length of each piezoelectric ceramic sheet of the same.

As is well known in the art, the piezoelectric actuator is produced such that after piezoelectric sheets on each of which a common electrode is provided and piezoelectric sheets on each of which an individual-electrode layer is provided are alternately stacked on each other and the stacked sheets are pressed, the stacked and pressed sheets are fired. Because of the firing, the three dimensions, i.e., length, width, and thickness of the stacked sheets are usually decreased. In particular, the length of the stacked sheets in the direction parallel to the array of nozzles is largely decreased. Therefore, in view of the amount (or rate) of decrease of the length, the interval at which the individual electrodes are formed is determined.

However, because the accuracy of production of piezoelectric actuators and the temperature at which piezoelectric actuators are fired are not sufficiently constant, it is difficult for each final product to have the regular interval, at which the individual electrodes are provided, that is equal to the regular interval at which the pressure chambers are provided. This leads to lowering the yield of final products.

To solve the above-indicated problem that the regular interval of the individual electrodes may not be equal to that of the pressure chambers, it is proposed not to increase the length of the piezoelectric actuator in the direction parallel to the array of nozzles, but to divide the piezoelectric actuators into a plurality of portions, i.e., a plurality of actuator units, in the same direction.

The above-indicated Patent Document 2 teaches that the individual and common electrodes sandwiched by the piezoelectric sheets are connected to external connection electrodes provided on an outer surface of the piezoelectric actuator so that an electric voltage is applied to the active portions of the piezoelectric actuator, and that the external connection electrodes are connected to connection electrodes of signal lines of a flat cable so that control signals are supplied from an external control device to the active portions of the piezoelectric actuator.

However, if the piezoelectric actuator is divided into the plurality of actuator units that are arranged in series in the direction parallel to the array of nozzles, and two flat cables are bonded to the respective top surfaces of the actuator units, another problem occurs. More specifically described, if the piezoelectric actuator is divided into the plurality of actuator units, e.g., two actuator units, the two actuators units are arranged in series such that respective one ends of the two actuator units are opposed to each other in the above-indicated direction. In each of the actuator units, one of the individual electrodes that is the nearest to the one end of the each actuator unit needs to be formed at a position distant from the one end by a certain first distance, and accordingly the pressure chambers need to be grouped into the same number of groups as the number of the actuator units, such that a second distance corresponding to the first distance is provided between the two groups of pressure chambers. However, in the case where the length of the array of nozzles is shortened to downsize the printer head, the second distance needs to be minimized.

Each of the flat cables is prepared such that first, signal lines and connection electrodes are formed by printing on a synthetic-resin sheet and then the each flat cable is obtained by punching a prescribed contour of the cable off the sheet. Two of the connection electrodes that are the nearest to two lengthwise opposite ends of the each flat cable, respectively, are located at respective positions distant from the corresponding opposite ends by a certain distant, in view of the accuracy of punching of cable and the ease of bonding of cable.

Therefore, when the above-indicated flat cables as they are bonded to the actuator units, respectively, such that the connection electrodes of the flat cables are electrically connected to the external connection electrodes of the actuator units, respective end portions of the flat cables interfere with each other, so that the strength of bonding of the flat cables with the actuator units is insufficiently small and the small bonding strength may lead to a problem such as failure of electric conduction.

Meanwhile, the above-indicated Patent Document 2 teaches that the piezoelectric sheets of the piezoelectric actuator include first piezoelectric sheets on each of which a proper-individual-electrode layer or pattern, i.e., a plurality of proper individual electrodes corresponding to the plurality of pressure chambers are provided; and second piezoelectric sheets on each of which a proper common electrode is provided, that each of the second piezoelectric sheets has, in addition to the proper common electrode provided thereon, a plurality of dummy individual electrodes corresponding to respective extended end portions of the proper individual electrodes provided on one or two first piezoelectric sheet that is or are adjacent the each second piezoelectric sheet in the direction of alternate stacking of the first and second piezoelectric sheets, and that each of the first piezoelectric sheets has, in addition to the proper individual electrodes provided thereon, a dummy common electrode corresponding to an extended end portion (i.e., a lead portion) of the proper common electrode provided on one or two second piezoelectric sheets that is or are adjacent the each first piezoelectric sheet in the stacking direction. Each first piezoelectric sheet additionally has internal connection electrodes that are formed of an electrically conductive material filling through-holes formed through the thickness of the sheet and connect between the proper common electrode and the dummy common electrode; and each second piezoelectric sheet additionally has internal connection electrodes that are formed of an electrically conductive material filling through-holes formed through the thickness of the sheet and connect between the proper individual common electrode and the dummy individual electrodes, respectively.

According to Patent Document 2, each of the dummy individual electrodes provided on each second piezoelectric sheet has, in its plan view, a rectangular shape similar to that of the extended end portion of each proper individual electrode and extends, in a direction perpendicular to two long sides of the each second piezoelectric sheet, to a position near a corresponding one of the two long sides. Each of the internal connection electrodes of the each second piezoelectric sheet is connected to an intermediate portion of a corresponding one of the dummy individual electrodes. The cross-sectional area of each internal connection electrode of each second piezoelectric sheet may be considerably smaller than the plan-view area of each dummy individual electrode.

As described above, the proper individual electrodes provided on each first piezoelectric sheet are arranged in an array such that the array of proper individual electrodes extends parallel to the array of pressure chambers and such that the proper individual electrodes are substantially aligned with the pressure chambers, respectively, in the plan view of the piezoelectric actuator. In addition, on the upper surface of the uppermost layer of the piezoelectric actuator, there are provided a plurality of individual surface electrodes that are electrically connected to the plurality of proper individual electrodes, respectively. The individual surface electrodes are located at respective positions that are offset from the active portions or the pressure chambers and are near to one of the two long sides of the piezoelectric actuator that are parallel to the array of active portions. The dummy individual electrodes connect between the proper individual electrodes and the individual surface electrodes, such that the respective one ends of the proper individual electrodes are extended to the respective positions offset from the pressure chambers and the dummy individual electrodes each of which has the shape similar to that of the extended end portion of each proper individual electrode are located at the respective positions corresponding to the respective extended end portions of the proper individual electrodes. This leads to increasing the length of extension of each dummy individual electrode in the direction perpendicular to the long sides of each piezoelectric sheet, and accordingly increasing the short sides of each piezoelectric sheet. Eventually, the plan-view size of the piezoelectric actuator is increased, i.e., cannot be reduced.

When the various electrodes, such as the proper and dummy individual electrodes and the proper and dummy common electrodes, are formed by screen printing, such a problem occurs that the area of each electrode may change from a nominal value, i.e., increase or decrease, because, e.g., the contour of the each electrode is deformed when the screen is removed. If this problem leads to excessively decreasing a distance between two electrodes next to each other, then another problem occurs that when an electric voltage is applied to the electrodes, an electric current may leak between two electrodes next to each other, and an undesired active portion different from the desired active portion may be operated. Thus, the printing quality of the printer head is lowered.

Meanwhile, each of the respective portions of each common electrode that are needed to provide the active portions of the piezoelectric actuator is essentially required to have, in the plan view of the actuator, an area substantially equal to that of each individual electrode, and is just required to be connected to the above-described lead portion of the each common electrode. However, Patent Document 2 teaches that each proper common electrode includes a central wide portion that covers, in the plan view of the piezoelectric actuator, the substantially entire central area of the corresponding second piezoelectric sheet, except for the two side areas in which the island-like dummy individual electrodes are provided. Each proper common electrode additionally includes two lead portions that are connected to two lengthwise opposite ends of the central wide portion, respectively.

Thus, the amount of electrically conductive material (e.g., electrically conductive paste), such as silver-palladium-based material, needed to form each common electrode is increased, and accordingly the cost of production of the piezoelectric actuator is increased.

Each of the active portions of the piezoelectric actuator is operated by applying a drive voltage to the individual electrodes and the common electrodes of the each active portion. Therefore, if the area of each common electrode is large, the electrostatic capacity of the piezoelectric actuator as a whole is increased and accordingly the drive voltage to be applied to each active portion to produce a desired amount of piezoelectric deformation of the each active portion is increased.

Moreover, Patent Document 2 teaches that a single piezoelectric actuator has two arrays of active portions. Therefore, the difficulty of the above-identified problems increases as the number of the arrays of the active portions increases.

SUMMARY OF THE INVENTION

It is therefore an object of the present invention to provide an ink jet printer head which is free from at least one of the above-identified problems.

It is another object of the present invention to provide such an ink jet printer head which can enjoy a small size.

It is another object of the present invention to provide such an ink jet printer head which can be driven with a low electric voltage and/or can be produced at a low cost.

Each of these objects may be achieved according to any of the following modes of the present invention.

(1) An ink jet printer head, comprising:

a cavity unit having a plurality of nozzles arranged in a reference direction, a plurality of pressure chambers which communicate with the nozzles, respectively, and a plurality of partition walls which separate the pressure chambers from each other;

a piezoelectric actuator having a plurality of active portions each of which is driven to change a pressure of an ink accommodated in a corresponding one of the pressure chambers, and thereby eject, from a corresponding one of the nozzles, a droplet of the ink, the cavity unit and the piezoelectric actuator being fixed to each other;

the piezoelectric actuator comprising a plurality of sheet members which are stacked on each other and include at least one piezoelectric sheet; at least one common electrode; and at least one individual-electrode layer including a plurality of individual electrodes which are aligned with the pressure chambers, respectively, and each of which cooperates with a corresponding one of a plurality of portions of the at least one common electrode to sandwich a corresponding one of a plurality of portions of the at least one piezoelectric sheet, in a direction of stacking of the sheet members, and thereby provide a corresponding one of the active portions of the piezoelectric actuator;

the piezoelectric actuator further comprising a plurality of external pads which are provided on an outer surface of an outermost sheet member of the sheet members and are electrically connected to a cable member through which drive signals for the active portions are transmitted; and a plurality of internal leads which electrically connect between the individual electrodes and the external pads, respectively; and the external pads being located, on the outer surface of the outermost sheet member of the piezoelectric actuator, at respective positions that are at least partially aligned with the partition walls each of which is located between corresponding two pressure chambers of the pressure chambers in the reference direction.

According to this mode, when the piezoelectric actuator is fixed to the cavity unit, the external pads of the actuator can be strongly pressed against the partition walls of the cavity unit that are alternate with the pressure chambers, so that the actuator can be reliably fixed to the cavity unit and accordingly the leakage of ink from each pressure chamber can be minimized. In addition, since the pressing force is not directly applied to each pressure chamber as a vacant space, each pressure chamber can be effectively prevented from being deformed and the actuator can be freed of cracks. Therefore, the present ink jet printer head as an end product can enjoy a designed printing quality.

(2) An ink jet printer head, comprising:

a cavity unit having a plurality of nozzles arranged in a reference direction, and a plurality of pressure chambers which communicate with the nozzles, respectively, and which are grouped into at least two groups of pressure chambers each group of which consists of at least two pressure chambers arranged in the reference direction;

a piezoelectric actuator having a plurality of active portions each of which is driven to change a pressure of an ink accommodated in a corresponding one of the pressure chambers, and thereby eject, from a corresponding one of the nozzles, a droplet of the ink, the cavity unit and the piezoelectric actuator being fixed to each other;

the piezoelectric actuator comprising at least two actuator portions each of which has a plurality of active portions and which are arranged next to each other in the reference direction such that respective one ends of the at least two actuator portions are opposed to each other in the reference direction, and such that the at least two actuator portions are opposed to the at least two groups of pressure chambers, respectively;

the each of the at least two actuator portions comprising a plurality of sheet members which are stacked on each other and include at least one piezoelectric sheet; at least one common electrode; and at least one individual-electrode layer including a plurality of individual electrodes which are aligned with the at least two pressure chambers of a corresponding one of the at least two groups of pressure chambers, respectively, and each of which cooperates with a corresponding one of a plurality of portions of the at least one common electrode to sandwich a corresponding one of a plurality of portions of the at least one piezoelectric sheet, in a direction of stacking of the sheet members, and thereby provide a corresponding one of the active portions of the each actuator portion;

the each of the at least two actuator portions further comprising a plurality of external pads which are provided on an outer surface of an outermost sheet member of the sheet members, such that the external pads are arranged in the reference direction, and are electrically connected to a flat cable; and a plurality of internal leads which electrically connect between the individual electrodes and the external pads, respectively; and one of the external pads of the each actuator portion that is nearest to the one end of the each actuator portion in the reference direction being more distant from the one end than one of the active portions of the each actuator portion that is nearest to the one end.

According to this mode, even if the cavity unit may have a great number of nozzles, the piezoelectric actuator is provided by a plurality of separate actuator portions each of which corresponds to an appropriate number of pressure chambers belonging to a corresponding one of a plurality of groups. Therefore, the active portions of the each of the actuator portions can be accurately positioned relative to the pressure chambers of the corresponding one group. According to this mode, a first distance between the respective one active portions of the two actuator portions that are nearest to the respective one ends thereof is greater than a second distance between each pair of active portions that are adjacent each other in each of the two actuator portions. However, an amount by which the first distance is greater than the second distance is too small. Therefore, if external pads to which flat cables are to be electrically connected, respectively, are provided right above the nearest active portions, respectively, then the first distance is too small for the flat cables to be appropriately connected to the external pads without being interfered with each other. In contrast, according to this mode, the internal pads which electrically connect, in each of the actuator portions, between the individual electrodes and the external pads, can be largely offset from the one end portion of the each actuator portion, and accordingly the external pads can also be largely offset from the respective one ends of the actuator portions. Thus, the flat cables can be easily connected to the external pads without being interfered with each other.

(3) An ink jet printer head, comprising:

a cavity unit having a plurality of nozzles arranged in a first direction, and a plurality of pressure chambers which communicate with the nozzles, respectively, and;

a piezoelectric actuator having a plurality of active portions each of which is driven to change a pressure of an ink accommodated in a corresponding one of the pressure chambers, and thereby eject, from a corresponding one of the nozzles, a droplet of the ink, the cavity unit and the piezoelectric actuator being fixed to each other;

the piezoelectric actuator comprising a plurality of sheet members which are stacked on each other and include at least one piezoelectric sheet; at least one common electrode; and at least one individual-electrode layer including a plurality of individual electrodes which are aligned with the pressure chambers, respectively, and each of which cooperates with a corresponding one of a plurality of portions of the at least one common electrode to sandwich a corresponding one of a plurality of portions of the at least one piezoelectric sheet, in a direction of stacking of the sheet members, and thereby provide a corresponding one of the active portions of the piezoelectric actuator;

the at least one common electrode being provided on one of opposite planar surfaces of the at least one piezoelectric sheet, such that the at least one common electrode is elongate in the first direction and has a first edge line parallel to the first direction;

the piezoelectric actuator further comprising a plurality of first internal leads which extend through a thickness of the at least one piezoelectric sheet; and a plurality of first internal pads which are electrically connected to the individual electrodes via the first internal leads, respectively, and which are provided on the one planar surface of the at least one piezoelectric sheet, such that each of the first internal pads is distant from the first edge line of the at least one common electrode by a first predetermined distance in a second direction perpendicular to the first direction, and extends in a third direction inclined by a first predetermined angle relative to the second direction.

According to this mode, since the first internal pads are inclined, a length of each first internal pad can be increased, while the distance between the each first internal pad and the first edge line of the common electrode is kept at the first predetermined distance. Therefore, even if, when the common electrode and the first internal pads are formed by, e.g., printing, the contour of common electrode and/or first internal pads may be deformed and the area of the same may be somewhat increased or decreased from a nominal value, no electric current leaks between two first internal pads next to each other, upon application of electric voltage to the same, because a distance greater than a certain distance is provided. Thus, only a desired active portion or portions of the piezoelectric actuator corresponding to a desired pressure chamber or chambers can be assuredly operated, which leads to exhibiting a good printing quality of the printer head. Consequently the short sides of the piezoelectric actuator can be decreased and accordingly the printer head can be reduced in size.

(4) An ink jet printer head, comprising:

a cavity unit having a plurality of nozzles arranged in a first direction, and a plurality of pressure chambers which communicate with the nozzles, respectively, and each of which is elongate in a second direction perpendicular to the first direction;

a piezoelectric actuator having a plurality of active portions each of which is driven to change a pressure of an ink accommodated in a corresponding one of the pressure chambers, and thereby eject, from a corresponding one of the nozzles, a droplet of the ink, the cavity unit and the piezoelectric actuator being fixed to each other;

the piezoelectric actuator comprising a plurality of sheet members which are stacked on each other and include at least one piezoelectric sheet; at least one common electrode; and at least one individual-electrode layer including a plurality of individual electrodes which are aligned with the pressure chambers, respectively, and each of which cooperates with a corresponding one of a plurality of portions of the at least one common electrode to sandwich a corresponding one of a plurality of portions of the at least one piezoelectric sheet, in a direction of stacking of the sheet members, and thereby provide a corresponding one of the active portions of the piezoelectric actuator;

the at least one common electrode including a plurality of first electrically conductive portions each of which at least partly overlaps a corresponding one of the pressure chambers, respectively, and is elongate in the second direction, and additionally including at least one second electrically conductive portion which extends in the first direction to connect respective one ends of the first conductive portions.

According to this mode, the common electrode includes the first electrically conductive portions each of which at least partly overlaps a corresponding one of the pressure chambers and is elongate in the second direction, and additionally includes the two second electrically conductive portions one of which electrically connects respective one ends of the first conductive portions to each other in the first direction and the other of which electrically connects the respective other ends of the first conductive portions to each other in the first direction. Therefore, the present common electrode can be formed using a smaller amount of electrically conductive paste than an amount of conductive paste that is needed to form a conventional common electrode that is provided on a substantially entire surface of a piezoelectric sheet. This leads to decreasing a production cost of the present printer head. In addition, an electrostatic capacity of the present head is smaller than that of a conventional head employing the conventional common electrode, by an amount corresponding to an amount by which an area of the present common electrode is smaller than that of the conventional one. Therefore, an electric voltage (i.e., a drive voltage) applied to the present piezoelectric actuator to eject a drop of ink from each nozzle can be decreased, and accordingly a low-voltage circuit board can be employed to supply the drive voltage. This leads to decreasing the production cost of the printer head. Moreover, since one of the two second conductive portions electrically connects, to each other in the first direction, the respective one ends of the first conductive portions each of which is elongate in the second direction, i.e., the lengthwise direction of each pressure chamber, and the other second conductive portion electrically connects the respective other ends of the first conductive portions to each other also in the first direction. Therefore, a voltage drop with respect to both the lengthwise direction of each first conductive portion and the first direction in which the first conductive portions are arranged, is small. Thus, the active portions of the piezoelectric actuator can be substantially uniformly operated.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
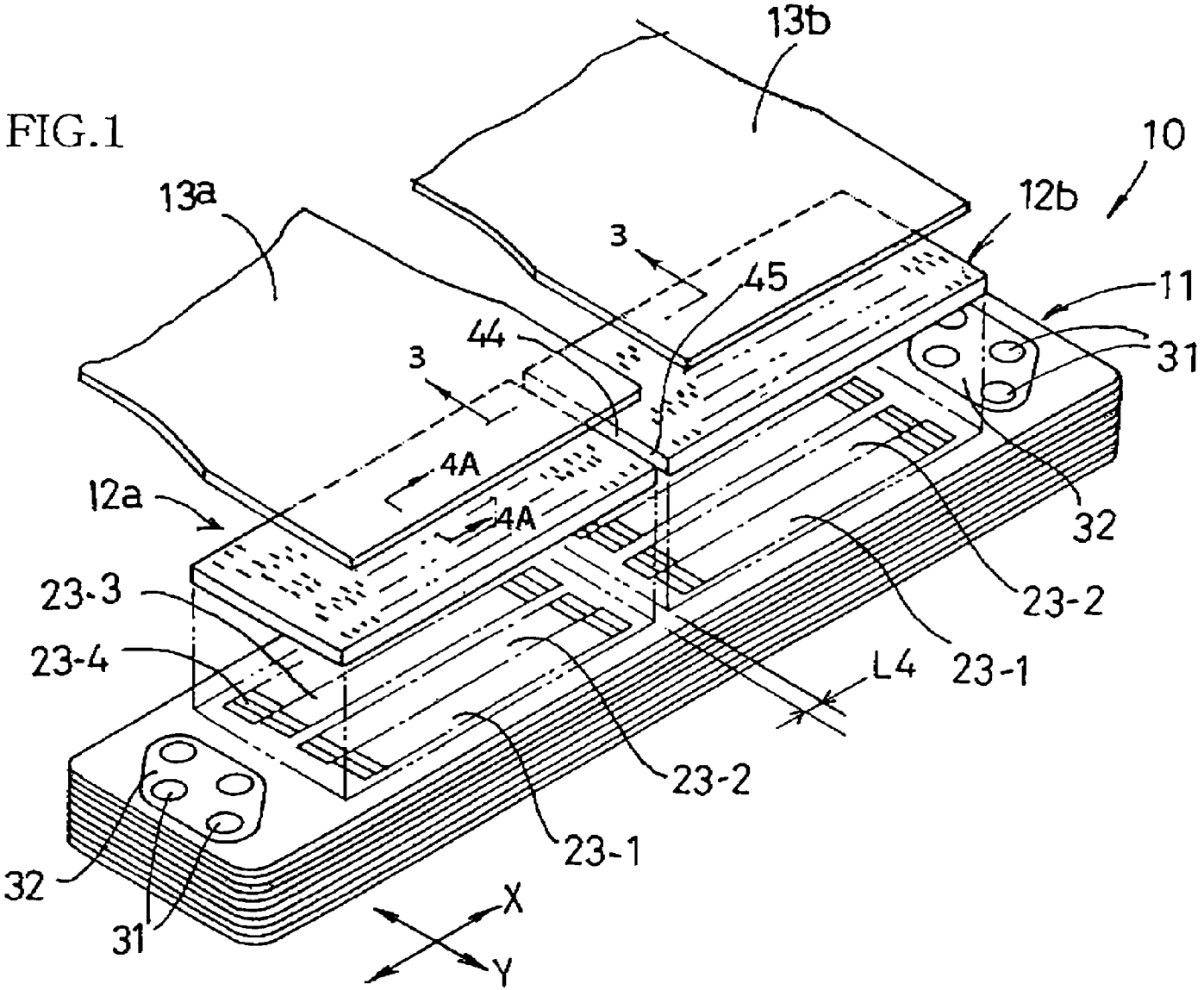
FIG. 1 is a perspective view of a piezoelectric-type ink jet printer head to which the present invention is applied, a cavity unit, a piezoelectric actuator (i.e., two actuator units), and a flexible flat cable (i.e., two cable units) of the printer head being separated from each other for illustrative purposes only.
Figure 2:
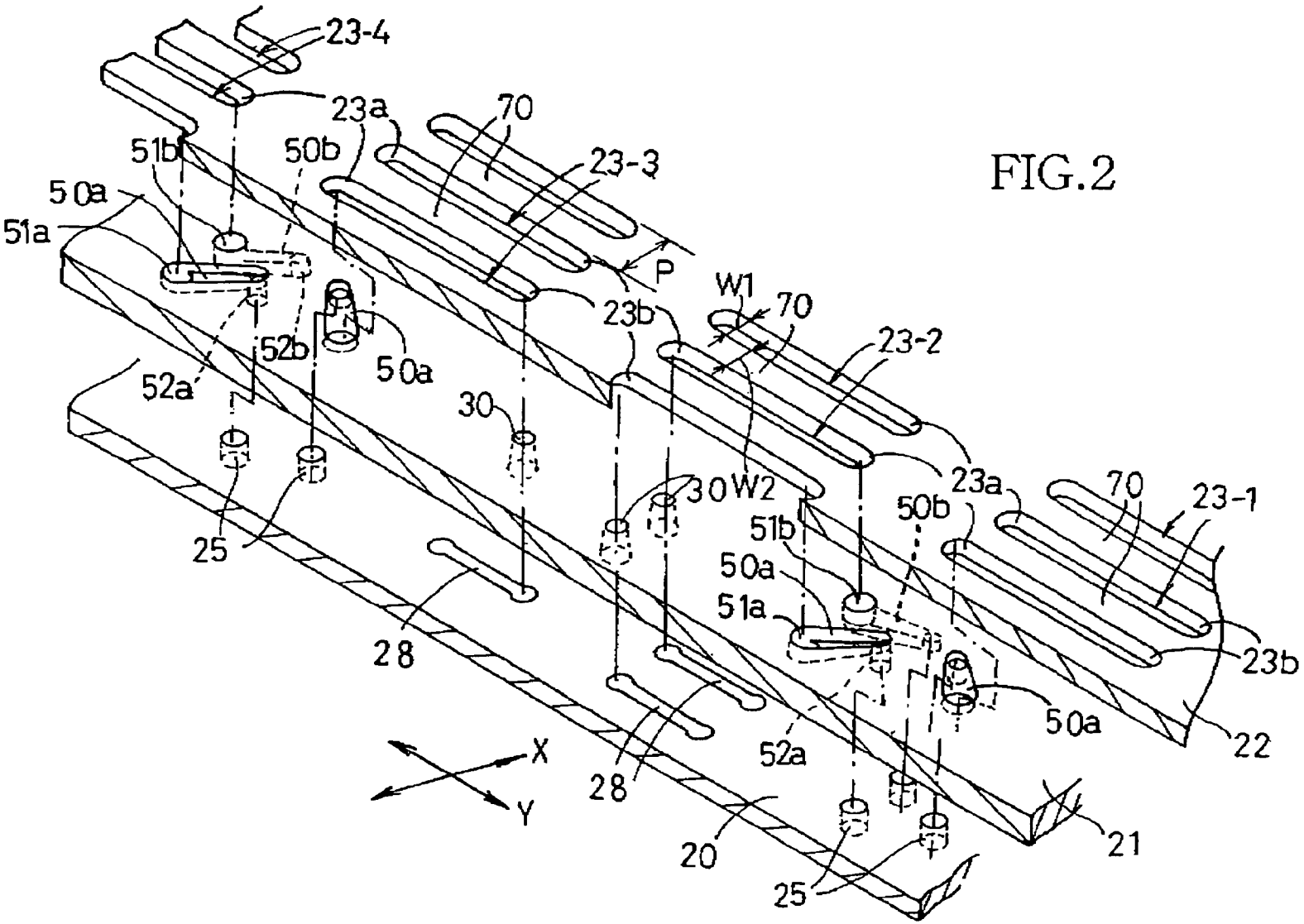
FIG. 2 is a perspective, exploded view of a portion of the cavity unit.

Hereinafter, there will be described preferred embodiments of the present invention by reference to the drawings. FIG. 1 shows a cavity unit 11 and a piezoelectric actuator 12 (i.e., two actuator units 12*a*, 12*b*) of a piezoelectric-type ink jet printer head 10 to which the present invention is applied; and FIG. 2 shows three sheet members each as part of the cavity unit 11, i.e., a base sheet 22, and a third and a second spacer sheet 21, 20 that are adjacent a lower surface of the base sheet 22. In FIG. 1, the sheet-stacked-type piezoelectric actuator 12 (i.e., the two actuator units 12*a*, 12*b*) is bonded to an upper surface of the metal-sheet-based cavity unit 11, and a flexible flat cable 13 (i.e., two cable units 13*a*, 13*b*; also see FIGS. 3 and 4A) as a sort of cable member is stacked on, and bonded to, an upper surface of the piezoelectric actuator 12. More specifically described, the two cable units 13*a*, 13*b* are bonded to the respective upper surfaces of the two actuator units 12*a*, 12*b*. The flexible flat cable 13 connects the piezoelectric actuator 12 to external devices, not shown, The cavity unit 11 is constructed as shown in FIGS. 2, 3, 4A, and 4B. More specifically described, the cavity unit 11 consists of nine thin sheet members that are stacked on, and bonded with adhesive to, each other. The nine sheets are, in the order from the bottom, to the top, of the cavity unit 11, a nozzle sheet 14, an intermediate sheet 15, a damper sheet 16, two manifold sheets 17, 18, a first, the second, and the third spacer sheets 19, 20, 21, and the base sheet 22. The base sheet 22 has pressure chambers 23. In the present embodiment, except for the nozzle sheet 14 formed of a synthetic resin, each of the other sheet members 15–22 is formed of a 42% nickel alloy steel sheet and has a thickness of from 50 μm to 150 μm.

Figure 3:
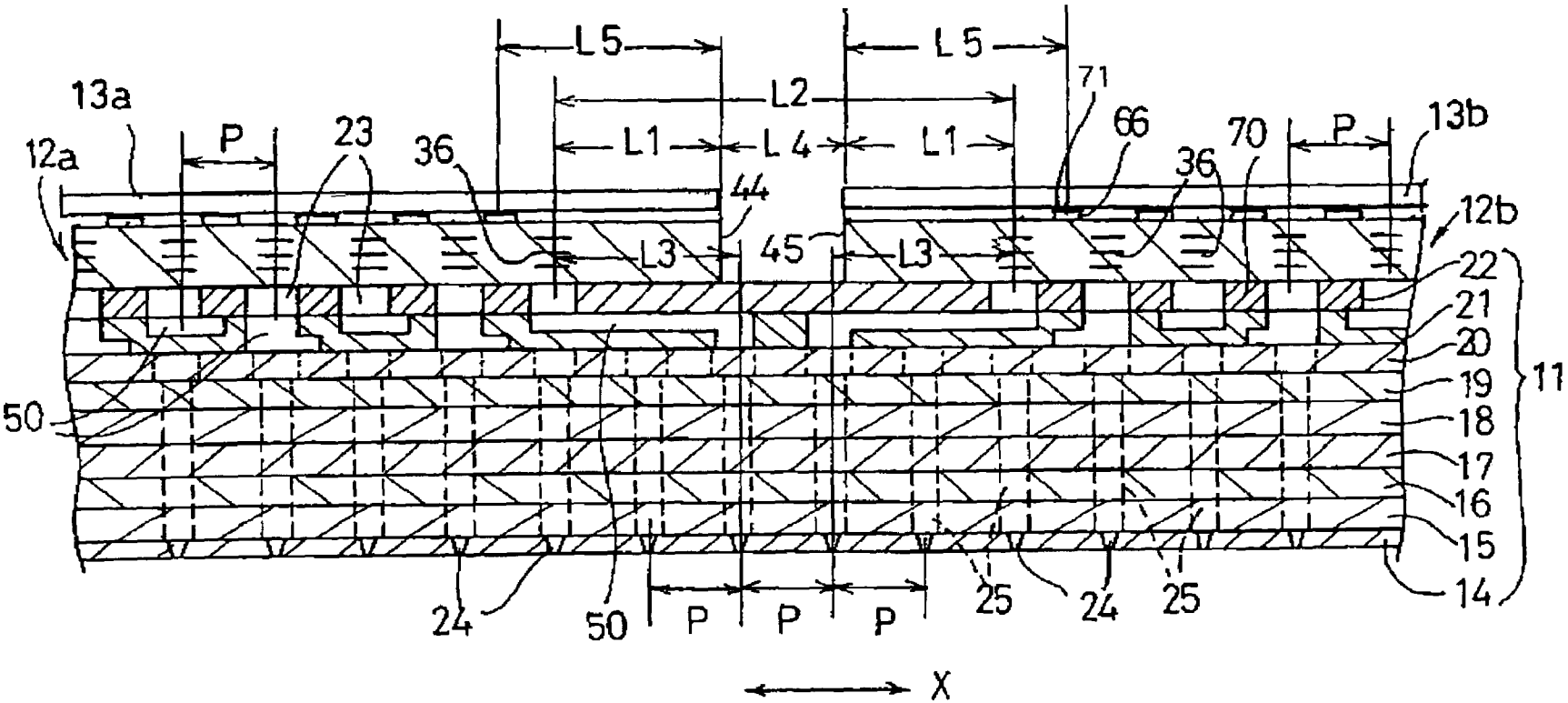
FIG. 3 is an enlarged, cross-sectional view taken along 3—3 in FIG. 1.

The nozzle sheet 14 has a number of ink-ejection nozzles 24 each having a small diameter (e.g., about 25 μm), such that the nozzles 24 are arranged in two pairs of arrays, i.e., four arrays in total, and each pair of arrays of nozzles 24 are arranged in a staggered or zigzag fashion in a first direction of the cavity unit 11 or the printer head 10, i.e., a lengthwise direction of the same 11, 10 or an X-axis direction indicated at arrows in FIGS. 1–3.

Figure 4A:
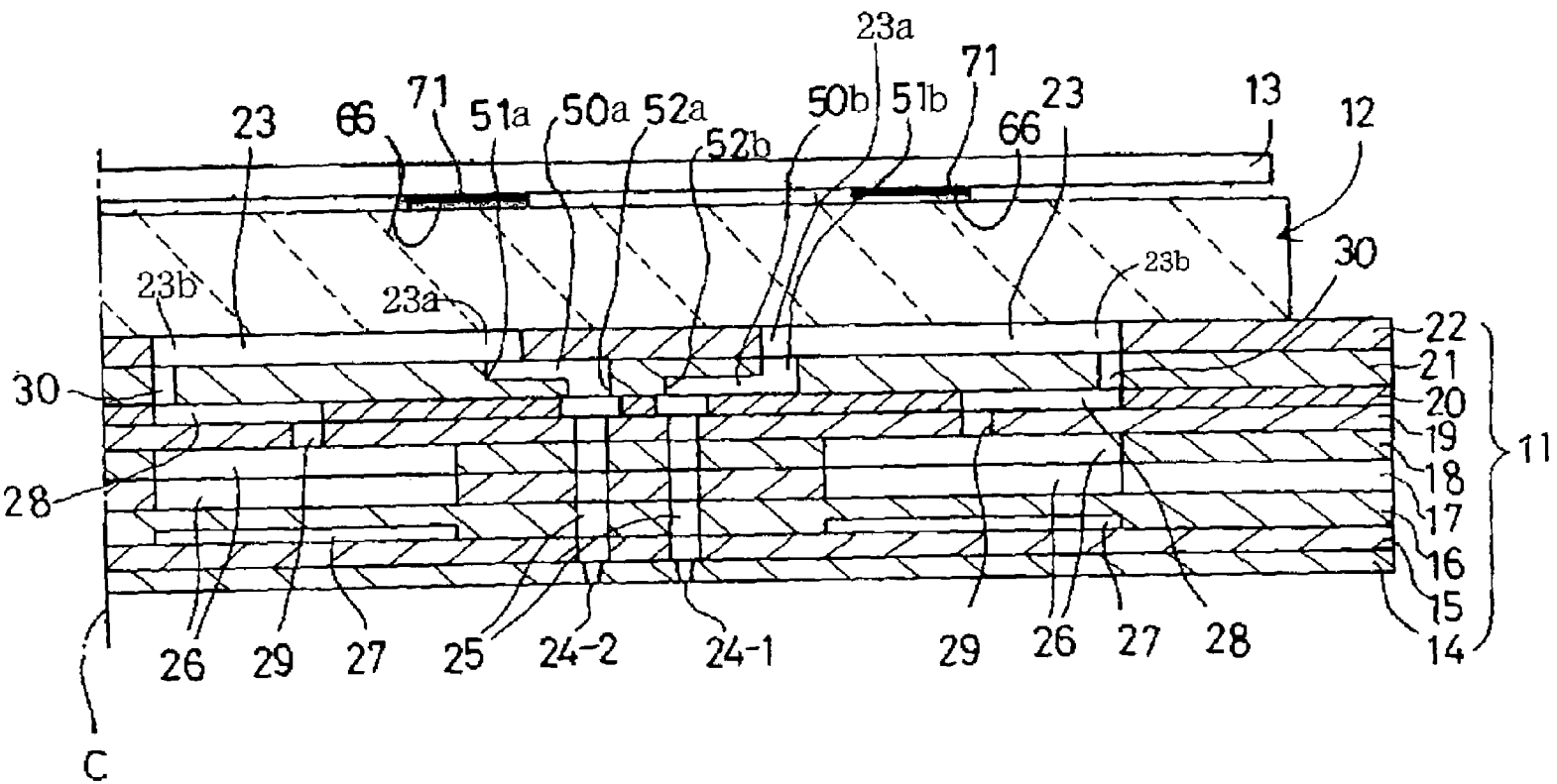
FIG. 4A is an enlarged, cross-sectional view taken along 4A—4A in FIG. 1.

FIG. 4A is a cross-sectional view of the cavity unit 11, taken along 4A—4A in FIG. 1, i.e., in a Y-axis direction or a widthwise direction of the cavity unit 11 or the printer head 10. More specifically described, FIG. 4A shows a half portion of the cavity unit 11, located on a right-hand side of a centerline, C, of the cavity unit 11 that is parallel to the X-axis direction. The right-hand half portion of the cavity unit 11 has the first array of nozzles 24-1 remote from the centerline C, and the second array of nozzles 24-2 near to the centerline C. The two arrays of nozzles 24-1, 24-2 are arranged along respective reference lines, not shown, that are near to each other and each parallel to the X-axis direction, in the above-described zigzag fashion, and the nozzles of each array 24-1, 24-2 are formed through the thickness of the nozzle sheet 14, at a regular small pitch, P, (FIG. 3). Likewise, a left-hand half portion of the cavity unit 11 has the third array of nozzles 24-3 near to the centerline C, and the fourth array of nozzles 24-4 remote from the centerline C. The two arrays of nozzles 24-3, 24-4 are arranged along respective reference lines, not shown, that are near to each other and each parallel to the X-axis direction, in the zigzag fashion, and the nozzles of each array 24-3, 24-4 are formed through the thickness of the nozzle sheet 14, at the regular small pitch P. The first and second arrays of nozzles 24-1, 24-2, i.e., the first pair of arrays of nozzles, and the third and fourth arrays of nozzles 24-3, 24-4, i.e., the second pair of arrays of nozzles are parallel to each other, and are distant from each other in a widthwise direction of the cavity unit 11 or the printer head 10, i.e., a second direction of the same 11, 10 or the Y-axis direction. In the present embodiment, each of the first to fourth arrays of nozzles is 2-inch long, and consists of 150 nozzles. Thus, the density of nozzles of the printer head 10 is 75 dpi (dot per inch.

Figure 13:
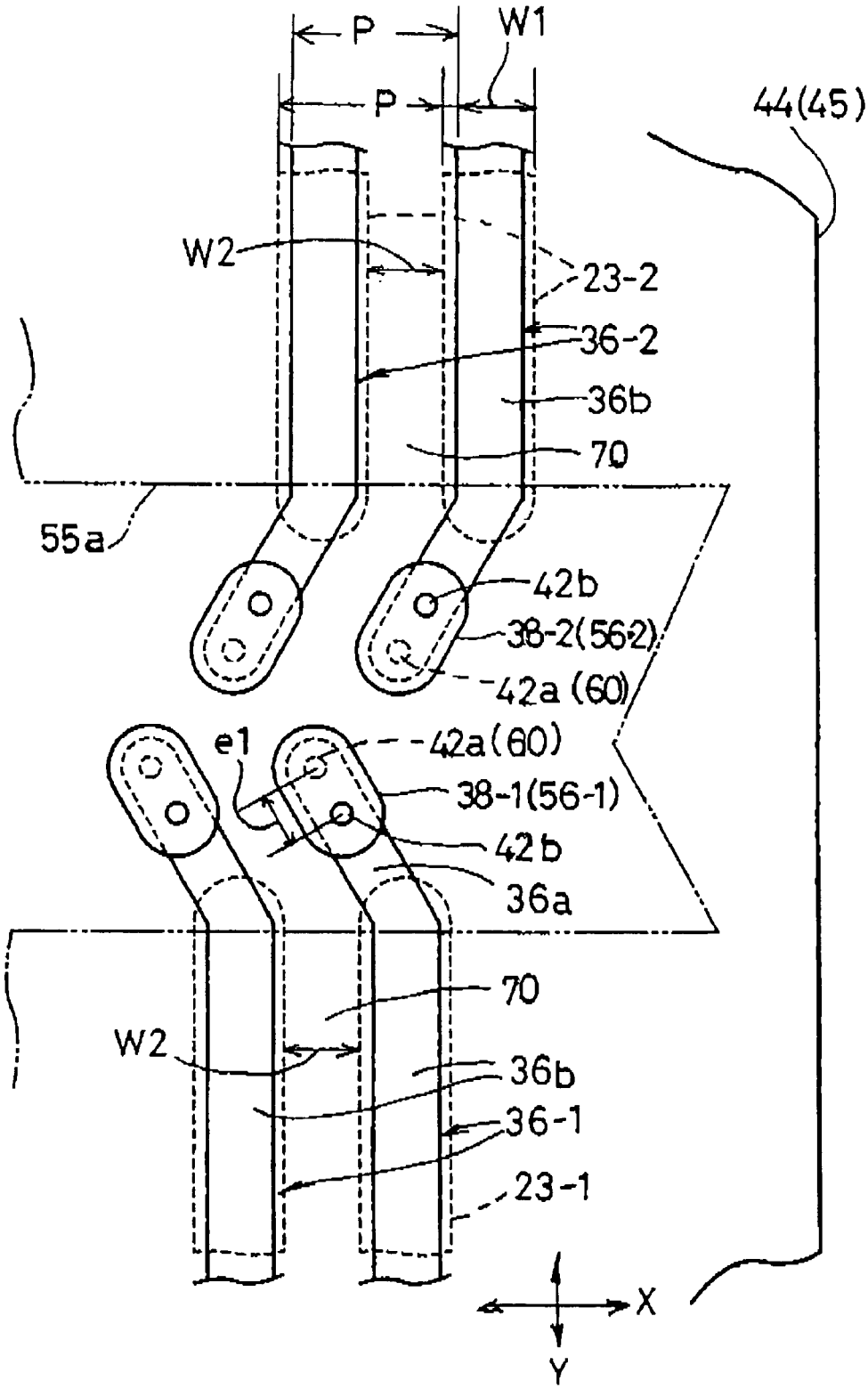
FIG. 13 is an enlarged, plan view of an active portion of the actuator unit, showing a positional relationship between proper and dummy individual electrodes and a pressure chamber, a portion of the actuator unit being cut away.

FIG. 2 shows the base sheet 22 as an uppermost sheet or layer of the cavity unit 11. The base sheet 22 has four arrays of pressure chambers 23 (23-1, 23-2, 23-3, 23-4) corresponding to the four arrays of nozzles 24, respectively, such that the arrays of pressure chambers 23 extend in the lengthwise direction of the cavity unit 11 or the X-axis direction. The pressure chambers 23 are formed through the thickness of the base sheet 22, at the same pitch P as the pitch P at which the nozzles 24 are formed. Each of the pressure chambers 23 is elongate and extends substantially parallel to the widthwise direction of the cavity unit 11 or the Y-axis direction. Thus, each pair of pressure chambers 23 next to each other are separated from each other by a partition wall 70 that is also elongate and extends substantially parallel to the Y-axis direction, as shown in FIGS. 2, 3, and 13. Each of the partition walls 70 has a width, W2, that is somewhat smaller than a width, W1, of each of the pressure chambers 23, as shown in FIGS. 2 and 13.

The pressure chambers of the first array 23-1 communicate with the nozzles of the first array 24-1, respectively. Likewise, the pressure chambers of the second array 23-2 communicate with the nozzles of the second array 24-2, respectively; the pressure chambers of the third array 23-3 communicate with the nozzles of the third array 24-3, respectively; and the pressure chambers of the fourth array 23-4 communicate with the nozzles of the fourth array 24-4, respectively.

Next, there will be described a positional relationship between the four arrays of pressure chambers 23 of the base sheet 22 as the uppermost layer of the cavity unit 11, and four arrays of active portions of the piezoelectric actuator 12 (i.e., the two actuator units 12*a*, 12*b*). The two actuator units 12*a*, 12*b* are provided on the base sheet 22, such that respective longitudinal axes of the two actuator units 12*a*, 12*b* are aligned with each other in the same direction as the direction in which the four arrays of nozzles 24 extend, i.e., in the first direction or the X-axis direction.

As shown in FIGS. 1 and 3, each of the two actuator units 12*a*, 12*b* operates respective half portions of the four arrays of pressure chambers 23 communicating with the four arrays of nozzles 24, and accordingly has 75 active portions for operating 75 pressure chambers 23 as the half portion of each of the four arrays of pressure chambers 23. Thus, as shown in FIGS. 1 and 3, one of the two actuator units 12*a*, 12*b* is provided on one of two half portions of the upper surface of the cavity unit 11 as seen in the lengthwise direction thereof, i.e., in the X-axis direction; and the other actuator unit is provided on the other half portion of the upper surface of the same 11.

Figure 5:
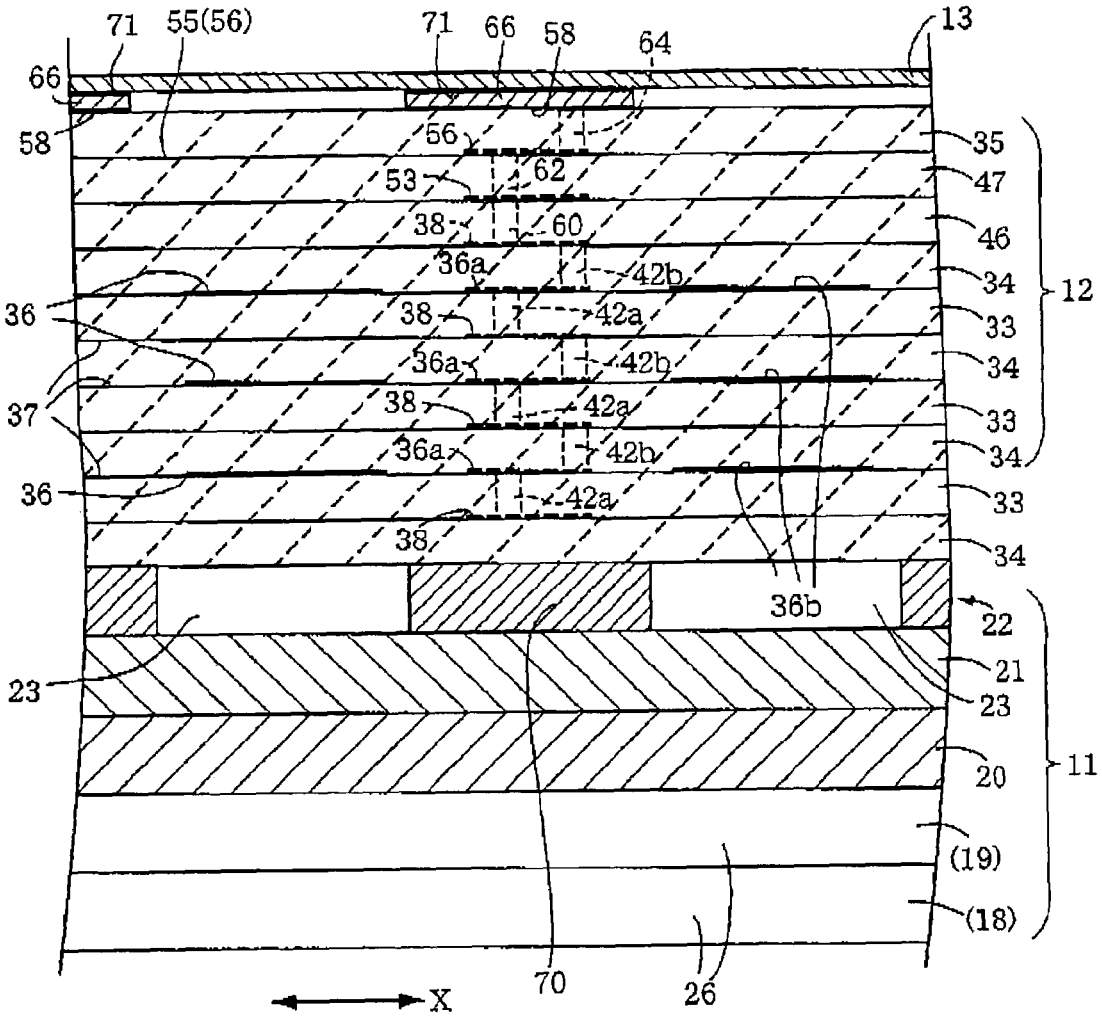
FIG. 5 is an enlarged, cross-sectional view of a portion of one of the two actuator units.

As will be described later in more detail by reference to FIGS. 5, 7, and 13, each of the active portions of each actuator unit 12*a*, 13*b* includes, for a corresponding one of the pressure chambers 23, respective portions of seven piezoelectric sheets 33, 34 stacked on each other, and three proper individual electrodes 36 and respective portions of three proper common electrodes 37 that are alternate with each other and are alternate with the respective portions of the seven piezoelectric sheets 33, 34. When an electric voltage is applied to the proper individual electrodes 36 and the proper common electrodes 37 of an arbitrary one of the active portions, the one active portion is deformed by piezoelectric effect in the direction of stacking of the piezoelectric sheets 33, 34. Thus, the two actuator units 12*a*, 12*b* cooperate with each other to provide the same number of active portions as the number of the pressure chambers 23 of the cavity unit 11, such that the active portions are arranged in the same number of arrays as the number (i.e., four) of the arrays of pressure chambers 23, and are formed at the respective positions aligned with the pressure chambers 23 in the direction of stacking of the sheets 33, 34, as shown in FIGS. 3 and 5.

In short, the active portions are arranged in the four arrays in the same direction as the direction in which the nozzles 24 or the pressure chambers 23 are arranged, i.e., in the X-axis direction, and the same number of active portions as the number (i.e., four) of the arrays of the nozzles 24 are arranged in the Y-axis direction. Each of the active portions is elongate in the Y-axis direction in which a corresponding one of the pressure chambers 23 is elongate, i.e., the widthwise direction of the cavity unit 11 or the printer head 10. The active portions of each of the four arrays are provided at the same pitch P as the pitch at which the pressure chambers 23 are provided, as shown in FIG. 3. The first and second arrays of active portions corresponding to the first and second arrays of pressure chambers 23-1, 23-2 are arranged in the zigzag fashion and, likewise, the third and fourth arrays of active portions corresponding to the third and fourth arrays of pressure chambers 23-3, 23-4 are arranged in the zigzag fashion.

As shown in FIG. 1, the pressure chambers 23 are grouped into two groups corresponding to the two actuator units 12*a*, 12*b* that are arranged in the lengthwise direction of the cavity unit 11 or the X-axis direction. More specifically described, the first group of pressure chambers 23 corresponding to the first actuator unit 12*a* are located in one of two half portions of the base sheet 22 as seen in the first direction or the X-axis direction parallel to the arrays of nozzles 24; and the second group of pressure chambers 23 corresponding to the second actuator unit 12*b* are located in the other half portion of the base sheet 22. In each of the two groups of pressure chambers 23, the pressure chambers 23 are arranged in the four arrays, such that first and second arrays of pressure chambers are arranged in the zigzag fashion and the third and fourth arrays of pressure chambers are also arranged in the zigzag fashion, and such that the pressure chambers of each of the four arrays are provided at the same pitch P as the pitch at which the nozzles 24 are provided.

Each of the pressure chambers 23 is elongate in the widthwise direction of the cavity unit 11, i.e., in the second direction or the Y-axis direction, and is formed through the thickness of the base sheet 22. Each pressure chamber 23 has an inlet end 23*b* that communicates with a corresponding one of manifold chambers 26, described later, via a second ink passage 30 formed in the third spacer sheet 21, a restrictor passage 28 formed in the second spacer sheet 20, and a first ink passage 29 formed in the first spacer sheet 19, as shown in FIGS. 2 and 4A.

In addition, each of the pressure chambers 23 has an outlet end 23*a* that communicates with a corresponding one of the nozzles 24 via respective communication passages 25 as part of an ink channel that are formed in the three spacer sheets 21, 20, 19, the two manifold sheets 18, 17, the damper sheet 16, and the intermediate sheet 15 all of which are interposed between the base sheet 22 and the nozzle sheet 14. One of the communication passages 25 that is formed in the third spacer sheet 21 is provided in the form of a bottomed groove 50 that extends substantially parallel to a plane defined by an upper or a lower surface of the sheet 21. However, at least one of the communication passages 25 that is formed in at least one of the sheet members or layers 21–15 interposed between the base sheet 22 and the nozzle sheet 14 may be provided in the form of the bottomed groove 50. Thus, as shown in FIGS. 2 and 3, the outlet end 23*a* of each pressure chamber 23 from which ink flows out is distant from the corresponding nozzle 24 by a distance, L3, as seen in the first direction or the X-axis direction.

More specifically described, as shown in FIGS. 1 and 3, the above-indicated two groups of pressure chambers 23 of the cavity unit 11, i.e., the respective groups of active portions of the two actuator units 12*a*, 12*b* are distant from each other by a distance, L2, that is longer than the regular pitch P at which the pressure chambers 23 are provided within each group in the lengthwise direction of the base sheet 22, Meanwhile, it is difficult to manufacture each actuator unit 12*a*, 12*b* in such a manner that a distance, L1, between the proper individual electrodes 36 of the respective outermost active portions of the four arrays of active portions of the each actuator unit 12*a*, 12*b*, and a corresponding end 44, 46 of the same 12*a*, 12*b* is not greater than half the regular pitch P at which the proper individual electrodes 36 are provided in the each actuator unit 12*a*, 12*b* in the lengthwise direction of the same 12*a*, 12*b*. Therefore, it is easier to manufacture the actuator units 12*a*, 12*b* such that the distance L1 is greater than half the pitch P, i.e., L1 >P/2, and accordingly the distance L2 is greater than the pitch P, i.e., L2>P.

In addition, as shown in FIGS. 1 and 3, the two actuator units 12*a*, 12*b* are arranged in series on the cavity unit 11, such that the respective ends 44, 45 of the two units 12*a*, 12*b* are opposed to each other and are distant from each other by a distance, L4, i.e., L2=2L1+L4.

Figure 19:
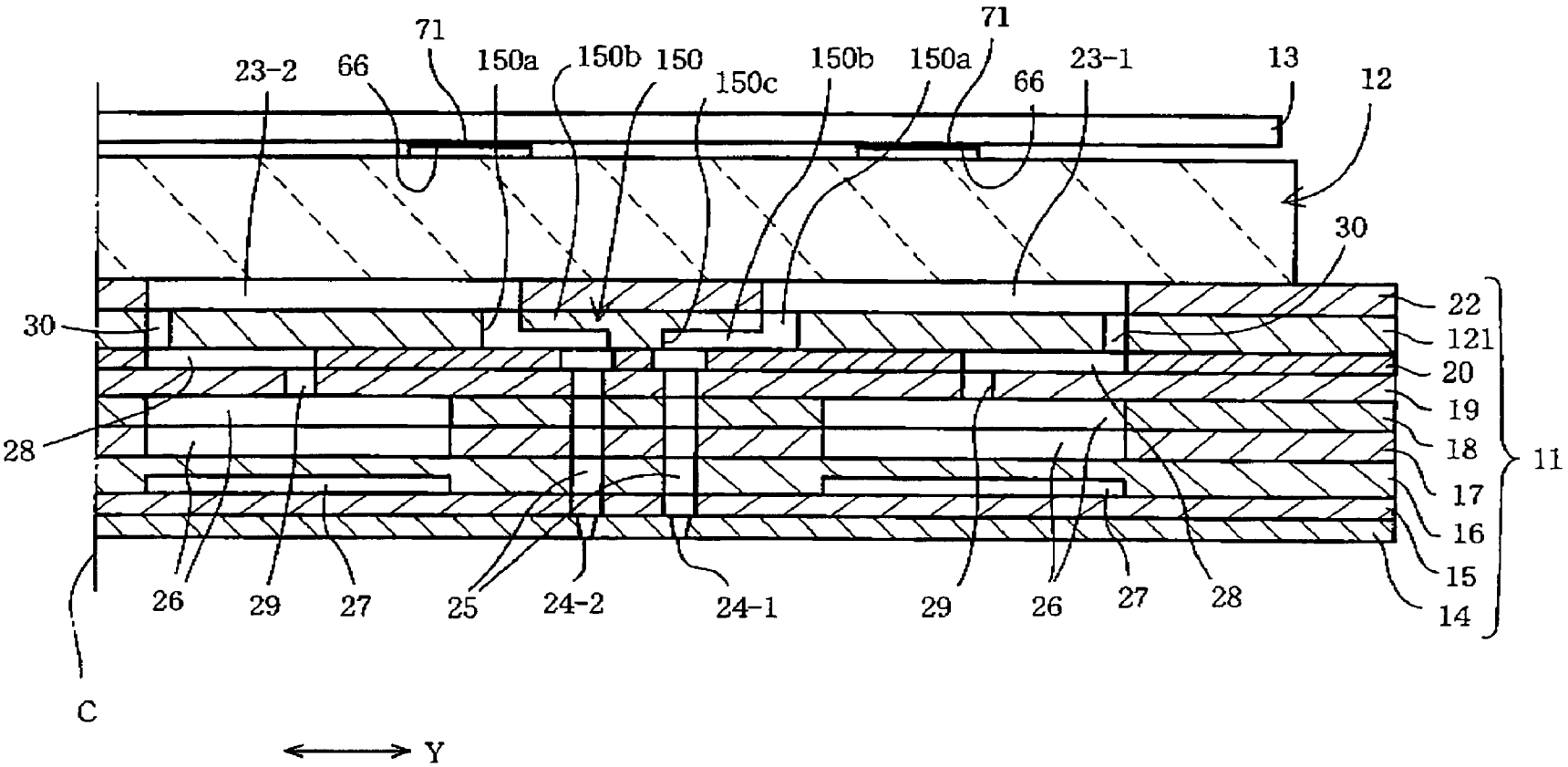
FIG. 19 is an enlarged, cross-sectional view corresponding to FIG. 4A, showing the cavity unit, a piezoelectric actuator, and a flexible flat cable of the printer head shown in FIG. 18.

That is, all the nozzles 24 of each of the four arrays are arranged at the regular pitch P, but each of the nozzles 24 is distant from a corresponding one of the pressure chambers 23 by the distance L3 in the first direction or the X-axis direction. As described above, the outlet end 23*a* of each pressure chamber 23 is connected to the corresponding nozzle 24 via the communication passages 25 at least one of which is provided in the form of the bottomed groove 50 extending parallel to the plane defined by at least one sheet member 21 in which the bottomed groove 50 is formed. Therefore, the other communication passages 25 are simply formed vertically through the respective thickness of the other sheet members 20–15, and are connected to one of opposite ends of the bottomed groove 50 formed in the sheet member 21. In the case where the bottomed groove 50 is formed in one of the intermediate sheet members 20–16, some of the other communication passages 25 are connected to one of opposite ends of the bottomed groove 50, and the other passages 25 are connected to the other end of the groove 50. Owing to this simple construction, each nozzle 24 is made distant from the corresponding pressure chamber 23 by the distance L3 in the first direction or the X-axis direction. However, as shown in FIGS. 2 and 19, each of the bottomed grooves 50 extends not only in the first direction but also in the second direction in which the corresponding pressure chamber 23 extends. Thus, the two groups of bottomed grooves 50 corresponding to the two groups of pressure chambers 23 are symmetrical with each other with respect to a bisector of the distance L2, such that each of the bottomed grooves 50 is inclined relative to the bisector.

In the present embodiment, the bottomed grooves 50 are formed in the third spacer sheet 21 adjacent the lower surface of the base sheet 22 having the pressure chambers 23. The construction of the bottomed grooves 50 will be described in more detail by reference to FIGS. 2, 3, and 4A. The bottomed grooves 50 include first bottomed grooves 50*a* each of which is formed in the upper surface of the third spacer sheet 21, and second bottomed grooves 50*b* each of which is formed in the lower surface of the third spacer sheet 21, such that the first bottomed grooves 50*a* are alternate with the second bottomed grooves 50*b* in the first direction or the X-axis direction.

Each of the first bottomed grooves 50*a* opens in the upper surface of the third spacer sheet 21, and is bottomed by etching an upper half portion of the thickness of the sheet 21. Each first groove 50*a* has one end 51*a* communicating with the outlet end 23*a* of the corresponding pressure chamber 23, and is fluid-tightly closed by the base sheet 22 adjacent the sheet 21. The other end 52*a* of each first groove 50*a* is formed through the entire thickness of the third spacer sheet 21, and communicates with the communication passage 25 formed through the thickness of the second spacer sheet 20 adjacent the lower surface of the third spacer sheet 21.

The second bottomed grooves 50*b* communicates with the respective outlet ends 23*a* of second pressure chambers 23 each of which is adjacent, in the first direction, a corresponding one of the first pressure chambers 23 with which the first bottomed grooves 50*a* communicate, respectively. Each of the second bottomed grooves 50*b* opens in the lower surface of the third spacer sheet 21, and is bottomed by etching a lower half portion of the thickness of the sheet 21. Each second groove 50*b* has one end 52*b* communicating with the communication passage 25 formed through the thickness of the second spacer sheet 20 adjacent the lower surface of the third spacer sheet 21, and is fluid-tightly closed by the second spacer sheet 20. The other end 51*b* of each second groove 50*b* is formed through the entire thickness of the third spacer sheet 21, and communicates with the outlet end 23*a* of the corresponding pressure chamber 23.

In the present embodiment, the first end 51*a*, 51*b* of each bottomed groove 50*a*, 50*b* that communicates with the outlet end 23*a* of the corresponding pressure chamber 23, has a cross-sectional area larger than that of the second end 52*a*, 52*b* thereof that communicates with the corresponding communication passages 25.

Since the bottomed grooves 50 formed in the third spacer sheet 21 include the first bottomed grooves 50*a* opening in the upper surface of the third sheet 21, and the second bottomed grooves 50*b* opening in the lower surface of the same 21, such that the first grooves 50*a* and the second grooves 50*b* are alternate with each other in the first direction, it is possible to design the first and second grooves 50*a*, 50*b* to be near to each other in the plan view of the cavity unit 11, because the first and second grooves 50*a*, 50*b* are fully isolated from each other by the thickness of the third sheet 21. Therefore, the degree of freedom of designing of the communication passages 25 as the ink channels can be greatly increased.

Though the cavity unit 11 consists of many sheet members 14–22 that are stacked on each other, the communication passages 25 as the ink channels connecting between the pressure chambers 23 of the base sheet 22 and the corresponding nozzles 24 of the nozzle sheet 14 can be easily designed such that the corresponding nozzles 24 are largely deviated from the pressure chambers 23, because at least one of the communication passages 25 corresponding to each pressure chamber 23 is provided in the form of the bottomed groove 50 extending parallel to the plane defined by the third spacer sheet 21, and the other communication passages 25 are formed through the respective thickness of the other sheet members 20–15 in respective directions perpendicular to respective planes defined by those sheet members 20–15. In addition, it is easy to design respective overall lengths of the communication passages 25 as the ink channels connecting between the pressure chambers 23 and the corresponding nozzles 24, each including the length of the bottomed groove 50*a*, 50*b*, such that the respective overall lengths of the communication passages 25 are substantially equal to each other.

The two manifold sheets 17, 18 cooperate with each other to define a plurality of manifold chambers 26, such that the manifold chambers 26 extend along the arrays of nozzles 24, respectively. More specifically described, each of the manifold chambers 26 has a length corresponding to a quotient obtained by dividing the length of each array of pressure chambers 23 in the first direction, by an appropriate integral number. In the present embodiment, each manifold chamber 26 has a length corresponding to the length of each array of pressure chambers 23 in each of the above-described two groups. Each group has 75 pressure chambers 23 in each array. Thus, the length of each manifold chamber 26 corresponds to the length of 75 pressure chambers arranged in array in the first direction. Thus, the two manifold sheets 17, 18 have eight manifold chambers 26 in total. One of lengthwise opposite ends of each of the eight manifold chambers 26 communicates with respective ink supply holes 31 that are formed in the three spacer sheets 19–21 and the base sheet 22 that are stacked on the manifold sheets 17, 18. The four ink supply holes 31 that are formed in each of opposite end portions of the uppermost base sheet 22 are covered with a filter 32 that removes dust from ink supplied from an ink supply source, not shown, such as an ink tank.

Each of the eight manifold chambers 26 is formed, by etching, through the respective thickness of the two manifold sheets 17, 18, and is fluid-tightly closed by the first spacer sheet 19 stacked on the upper manifold sheet 18, and the damper sheet 16 located beneath the lower manifold sheet 17. The damper sheet 16 has eight damper chambers 27 which are formed, by etching, in a lower surface of the sheet 16 and each of which has a plan-view shape identical with that of each manifold chamber 26.

A pressure wave that is applied by the actuator unit 12 to each pressure chamber 23 includes a backward component that propagates backward to the corresponding manifold chamber 26. This backward component is effectively absorbed by vibration of the thin damper sheet 16, and so-called "cross-talk" between two or more pressure chambers 23 adjacent each other is prevented.

Figure 4B:
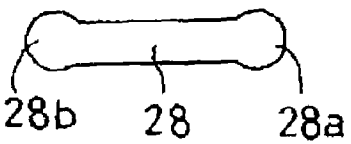
FIG. 4B is an enlarged, plan view of a restrictor passage formed in a sheet member of the cavity unit.

The second spacer sheet 20 has restrictor passages 28 each of which restricts flow of ink. As shown in FIG. 4B, each of the restrictor passages 28 has a plan-view shape including two axially opposite end portions 28*a*, 28*b*, and an intermediate portion whose width is smaller than that of the end portions 28*a*, 28*b*. Each restrictor passage 28 is elongate in a direction parallel to the direction in which the corresponding pressure chamber 23 is elongate. Each restrictor passage 28 is fluid-tightly closed by the third spacer sheet 21 stacked on an upper surface of the second spacer sheet 20, and the first spacer sheet 19 located beneath a lower surface of the same 20. As shown in FIGS. 2 and 4A, the first spacer sheet 19 has first ink passages 29 which are formed through the thickness thereof and each of which communicates with a corresponding one of the manifold chambers 26 and with the one end portion 28*a* of a corresponding one of the restrictor passages 28; and the third spacer sheet 21 has second ink passages 30 which are formed through the thickness thereof and each of which communicates with the inlet end 23*b* of a corresponding one of the pressure chambers 23 and with the other end portion 28*b* of a corresponding one of the restrictor passages 28.

Meanwhile, as shown in FIG. 5, each of the two actuator units 12*a*, 12*b* consists of ten sheet members stacked on each other. The ten sheet members include seven piezoelectric ceramic sheets 33, 34 each having a thickness of about 30 μm; two binder layers or sheets 46, 47 stacked on the piezoelectric sheets 33, 34; and a top sheet 35 stacked on the binder sheets 46, 47. Each of the binder sheets 46, 47 and the top sheet 35 may be provided by a piezoelectric ceramic sheet, or any other sort of electrically insulating material.

The seven piezoelectric sheets 33, 34 include three first piezoelectric sheets 33 and four second piezoelectric sheets 34, such that the second sheets 34 and the first sheets 34, 33 are alternate with each other in the direction of stacking of the sheets 33, 34. As shown in FIG. 7, a proper common electrode 37 is provided on a planar upper surface of each of the four second sheets 34; and as shown in FIG. 8, a proper-individual-electrode layer or pattern, i.e., four arrays of proper individual electrodes 36 (36-1, 36-2, 36-3, 36-4) each having a small width are provided, on a planar upper surface of each of the three first sheets 33, at respective positions corresponding to the pressure chambers 23 (indicated at broken line) provided in the cavity unit 11. The four arrays of proper individual electrodes 36-1, 36-2, 36-3, 36-4 extend in the first direction, i.e., the lengthwise direction of each first piezoelectric sheet 33 or the X-axis direction in which the four arrays of nozzles 24-1, 24-2, 24-3, 24-4 extend.

The first and fourth arrays of proper individual electrodes 36-1, 36-4 of each proper-individual-electrode layer or pattern are located along opposite long sides of the corresponding first piezoelectric sheet 33. The second and third arrays of proper individual electrodes 36-2, 36-3 are located on respective widthwise intermediate portions of the first piezoelectric sheet 33.

Each of the proper individual electrodes 36 of each proper-individual-electrode layer extends parallel to opposite short sides of the corresponding first piezoelectric sheet 33, in the second direction (or the Y-axis direction perpendicular to the first direction. Each of the proper individual electrodes 36 (36-1, 36-2, 36-3, 36-4) includes a straight portion 36*b* which has a length substantially equal to that of each pressure chamber 23 (23-1, 23-2, 23-3, 23-4), indicated at broken line in FIG. 8, and a width somewhat smaller than that of the same 23. Each proper individual electrode 36 overlaps, in its plan view, the corresponding pressure chamber 23. Respective end portions 36*a* of the proper individual electrodes 36 of the first array 36-1 are near to respective end portions 36*a* of the proper individual electrodes 36 of the second array 36-2; and respective end portions 36*a* of the proper individual electrodes 36 of the third array 36-3 are near to respective end portions 36*a* of the proper individual electrodes 36 of the fourth array 36-4. The end portion 36*a* of each proper individual electrode 36 is inclined, in its plan view, by an acute angle, α (e.g., 60 degrees), relative to the straight portion 36*b* of the same 36, such that the end portion 36*a* reaches a position distant from the corresponding pressure chamber 23. More specifically described, as shown in FIG. 8, each of the respective end portions 36*a* of the proper individual electrode 36 is inclined, in its plan view, in a direction away from the end 44, 45 of each actuator unit 12*a*, 12*b*. In addition, the respective end portions 36*a* of the proper individual electrodes 36 of the first array 36-1 and the respective end portions 36*a* of the proper individual electrodes 36 of the second array 36-2 are so inclined as to approach each other; and, likewise, the respective end portions 36*a* of the proper individual electrodes 36 of the third array 36-3 and the respective end portions 36*a* of the proper individual electrodes 36 of the fourth array 36-4 are so inclined as to approach each other.

As shown in FIG. 13, each of the respective end portions 36*a* of the proper individual electrodes 36 is located at a position where the each end portion 36*a* at least partly overlaps, in its plan view, a corresponding one of dummy individual electrodes 38 provided on each of the second piezoelectric sheets 34 except for the bottom sheet 34, and a corresponding one of first connection members 53 provided on the lower binder sheet 46 (FIG. 9), and is electrically connected to a corresponding one of internal connection electrodes 42*a* extending through the thickness of each fist piezoelectric sheet 33 except for the lowest sheet 33, a corresponding one of internal connection electrodes 42*b* extending through the thickness of each second piezoelectric sheet 34 except for the bottom sheet 34, and a corresponding one of internal connection electrodes 60 extending through the thickness of the lower binder sheet 46.

On each of the three first piezoelectric sheets 33, there is provided a dummy common electrode 43 that partly overlaps, in its plan view, the proper common electrode 37 provided on each second piezoelectric sheet 34, such that the dummy common electrode 43 surrounds the first and second arrays of proper individual electrodes 36-1, 36-2 and also surrounds the third and fourth arrays of proper individual electrodes 36-3, 36-4.

Figure 7:
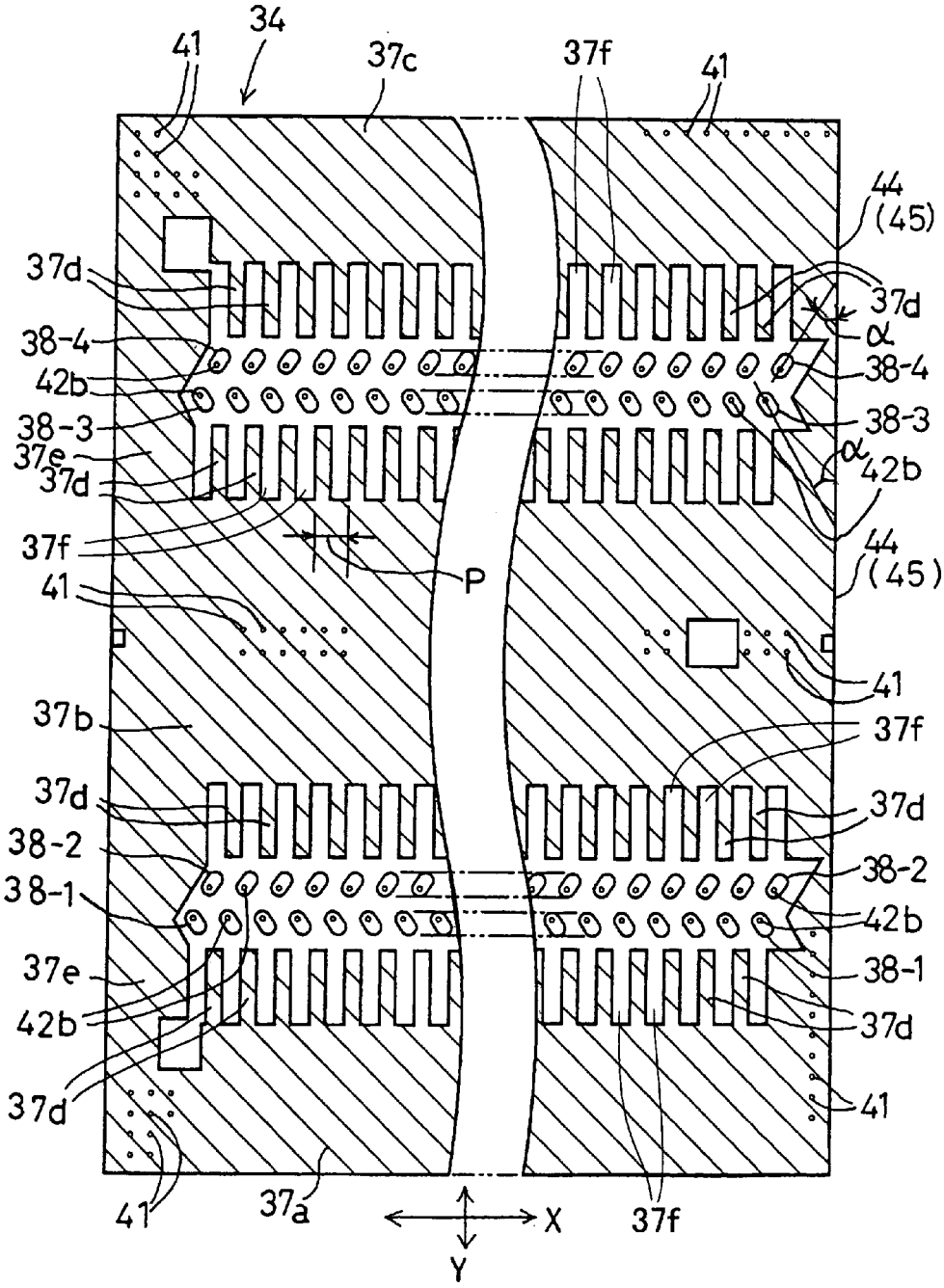
FIG. 7 is an enlarged, plan view of a piezoelectric sheet of the actuator unit, showing a proper common electrode, a portion of the piezoelectric sheet being cut away.
Figure 8:
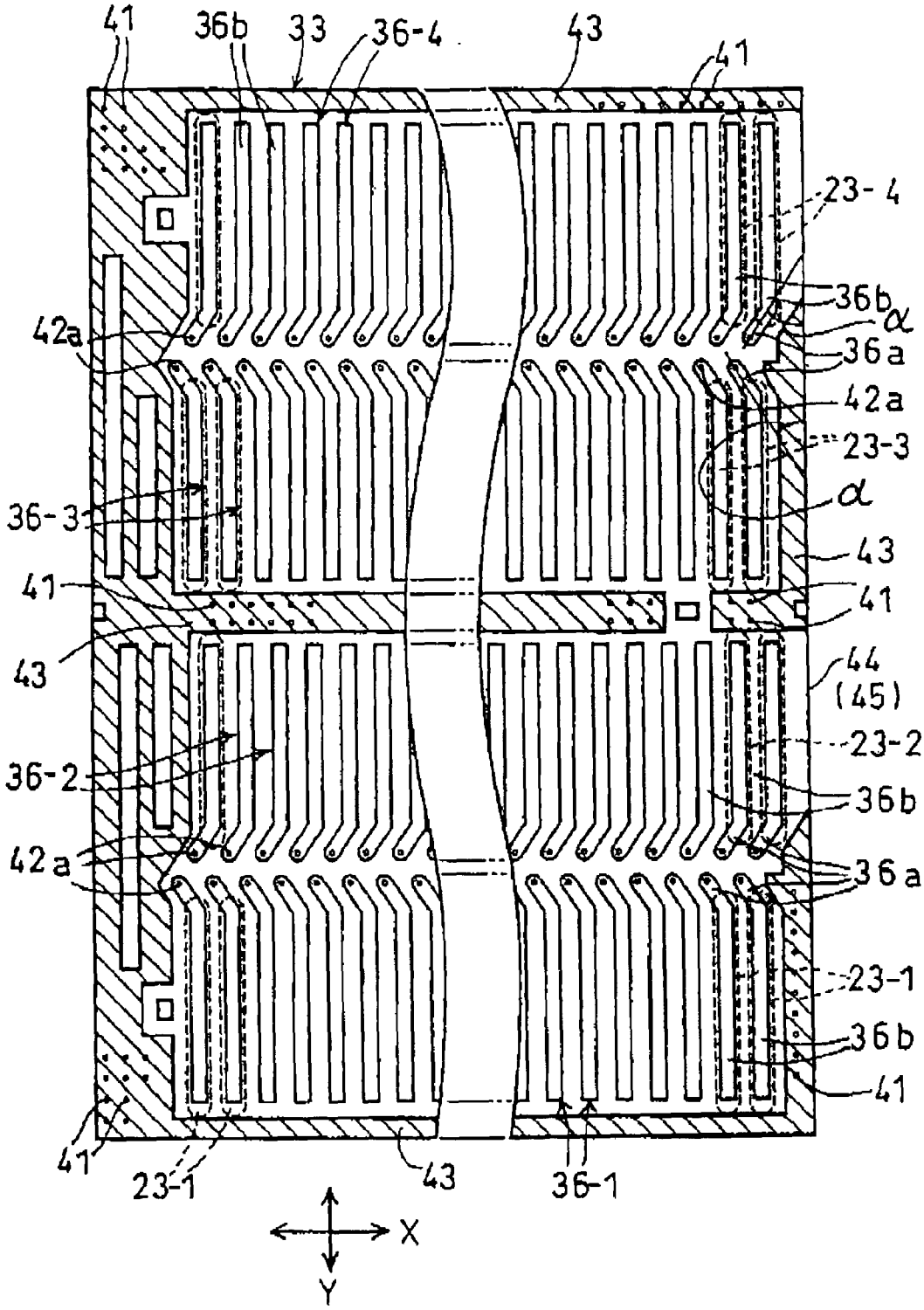
FIG. 8 is an enlarged, plan view of a piezoelectric sheet of the actuator unit, showing proper individual electrodes, a portion of the piezoelectric sheet being cut away.

Each of the four proper common electrodes 37 is formed, by printing, on a corresponding one of the four second piezoelectric sheets 34, as shown in FIG. 7. Each proper common electrode 37 includes three stem portions 37*a*, 37*b*, 37*c* each elongate in the first direction, i.e., the X-axis direction or the lengthwise direction of the corresponding second piezoelectric sheet 34, and two connection portions 37*e* that connect the three stem portions 37*a*–37*c* to each other and extend along two opposite short sides of the sheet 34, respectively. The two side stem portions 37*a*, 37*b* extend along two opposite long sides of the second piezoelectric sheet 34, and the central stem portion 37*b* extends on a widthwise intermediate portion of the sheet 34, i.e., an intermediate portion of the same 34 as seen in the Y-axis direction. The first side stem portion 37*a* overlaps, in its plan view, respective major portions of the respective straight portions 36*b* of the proper individual electrodes of the first array 36-1; the second side stem portion 37*c* overlaps, in its plan view, respective major portions of the respective straight portions 36*b* of the proper individual electrodes of the fourth array 36-4; and the central stem portion 37*b* overlaps, in its plan view, respective major portions of the respective straight portions 36*b* of the proper individual electrodes of the second and third arrays 36-2, 36-3.

Each proper common electrode 37 additionally includes a plurality of comb-teeth-like projections 37*d* that project from each of the three stem portions 37*a*, 37*b*, 37*c* in the Y-axis direction, and further includes a plurality of non-conductive areas 37*f* that are not electrically conductive and are alternate with the comb-teeth-like projections 37*d* in the X-axis direction, as shown in FIG. 7. The comb-teeth-like projections 37*d* are arranged at the same pitch P as the pitch at which the proper individual electrodes of each array 36-1, 36-2, 36-3, 36-4 are arranged, i.e., the pitch at which the pressure chambers of each array 23-1, 23-2, 23-3, 23-4 are arranged. In addition, each of the projections 37*d* overlaps, in its plan view, the remaining portion of the straight portion 36*b* of a corresponding one of the proper individual electrodes 36.

Between the first and second arrays of projections 37*d*, there are provided first and second arrays of generally elliptic dummy individual electrodes 38-1, 38-2; and between the third and fourth arrays of projections 37*d*, there are provided third and fourth arrays of generally elliptic dummy individual electrodes 38-3, 38-4. The dummy individual electrodes 38 of each array are arranged at a certain regular pitch, such that each of the dummy individual electrodes 38 (38-1, 38-2, 38-3, 38-4) at least partly overlaps, in its plan view, the end portion 36*a* of a corresponding one of the proper individual electrodes 36 (36-1, 36-2, 36-3, 36-4). Each elliptic dummy individual electrode 38 extends, in its plan view, in the same direction as the direction in which the end portion 36*a* of the corresponding proper individual electrode 36 extends. In other words, each dummy individual electrode 38 and the corresponding proper individual electrode 36 are inclined, in their plan view, by the acute angle $\alpha$ (e.g., 60 degrees) relative to the straight line defined by the end 44, 45 of each actuator unit 12*a*, 12*b*.

The dummy individual electrodes 38 will be referred, if appropriate, to first island-like individual electrical conductors that are isolated from each other on each second piezoelectric sheet 34. As indicated at two-dot chain line in FIG. 17, a distance between each dummy individual electrode 38 and a straight line defined by respective ends 37*d*1 of the projections 37*d* of the array corresponding to the each electrode 38, and a distance between each pair of dummy individual electrodes 38 next to each other in the first direction is selected at a value, e2.

Figure 17:
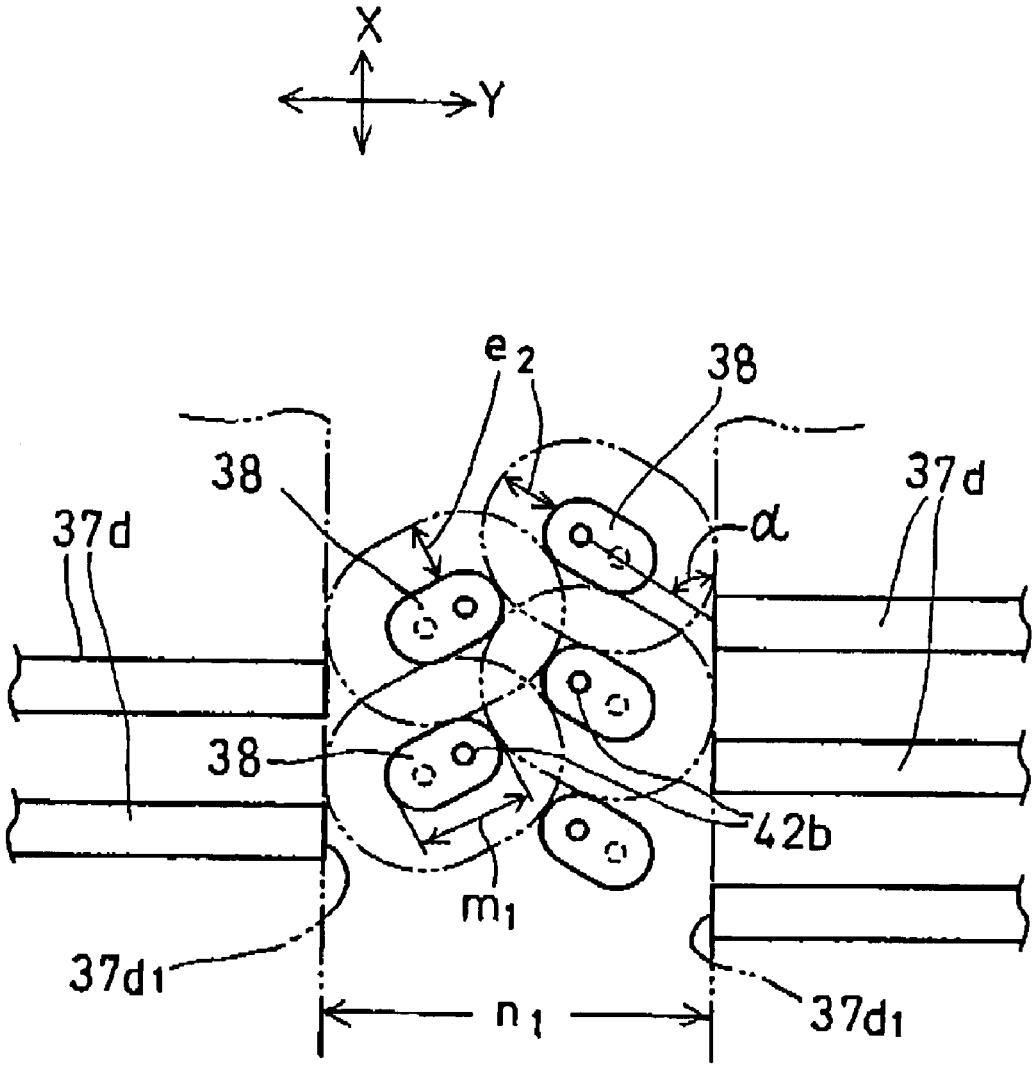
FIG. 17 is an enlarged, plan view for explaining, in more detail, the proper common electrode and the dummy individual electrodes shown in FIG. 7.

Since the dummy individual electrodes 38 are inclined, a lengthwise dimension, m1, of each dummy electrode 38 can be increased, while the distance between the each dummy electrode 38 and the straight line defined by the respective ends 37*d*1 of the projections 37*d* and the distance between each pair of dummy electrodes 38 next to each other in the first direction are each kept at the value e2. In addition, a distance, n1, between the straight line defined by the respective ends 37*d*1 of the projections 37*d* of one array and the straight line defined by the respective ends 37*d*1 of the projections 37*d* of another array opposed to the one array can be decreased, as shown in FIGS. 7 and 17. Therefore, even if, when the proper common electrode 37 and the four arrays of dummy individual electrodes 38 are formed by printing, the contour of each electrode 37, 38 may be deformed and/or the area of each electrode 37, 38 may be somewhat increased or decreased from a nominal value, no electric current leaks between two common and individual electrodes 37, 38, or two individual electrodes 38, 38, next to each other, upon application of electric voltage to the electrodes 37, 38, because the above-indicated distance e2 is kept. Thus, only a desired active portion or portions of the piezoelectric actuator 12 (i.e., the actuator units 12*a*, 12*b*) corresponding to a desired pressure chamber or chambers 23 can be reliably operated, which leads to exhibiting a good printing quality of the printer head 10. Consequently the short sides of each actuator unit 12*a*, 12*b*, i.e., the Y-axis-direction dimension of the same 12*a*, 12*b* can be decreased and accordingly the printer head 10 can be downsized.

Figure 6:
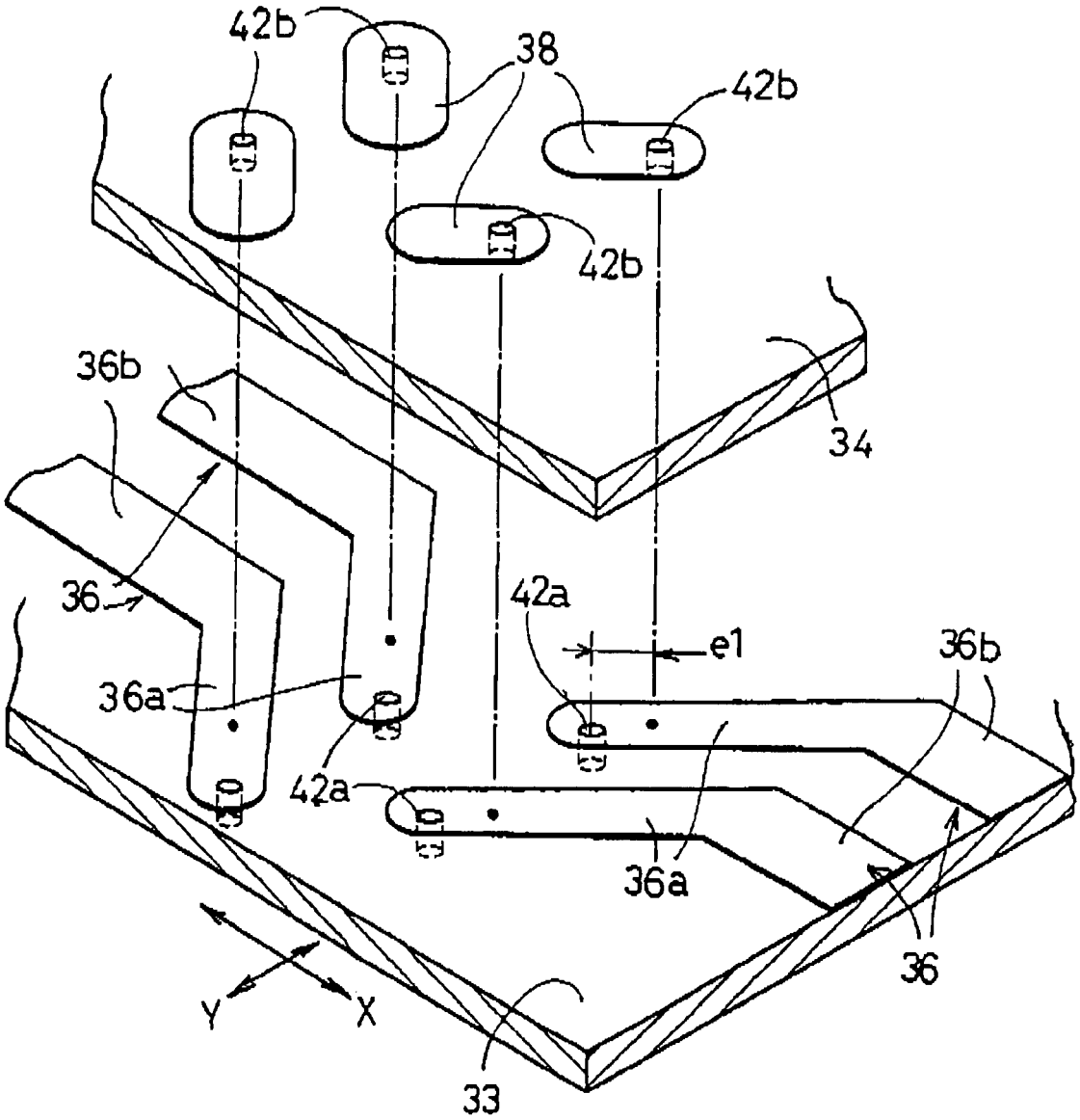
FIG. 6 is an enlarged, perspective view of respective portions of piezoelectric sheets of the actuator unit, showing a positional relationship between proper individual electrodes, dummy individual electrodes, and internal connection electrodes all of which are supported by the piezoelectric sheets.

A plurality of portions of each of the proper common electrodes 37, and a plurality of portions of each of the dummy common electrodes 43 are electrically connected to each other, in the direction of stacking of the piezoelectric sheets 33, 34, by a plurality of internal connection electrodes 41 that are formed of an electrically conductive material (i.e., an electrically conductive paste) filling a plurality of through-holes formed through the thickness of each of the piezoelectric sheets 33, 34 except for the bottom sheet 34. Similarly, the respective end portions 36*a* of the proper individual electrodes of the four arrays 36-1, 36-2, 36-3, 36-4 provided on each of the first piezoelectric sheets 33, and the dummy individual electrodes of the four arrays 38-1, 38-2, 38-3, 38-4 provided on each of the second piezoelectric sheets 34 except for the bottom sheet 34 are electrically connected to each other, in the direction of stacking of the piezoelectric sheets 33, 34, by a plurality of internal connection electrodes 42*a* that are formed of an electrically conductive material filling a plurality of through-holes formed through the thickness of each of the first piezoelectric sheets 33 except for the lowermost sheet 33, and a plurality of internal connection electrodes 42*b* that are formed of an electrically conductive material filling a plurality of through-holes formed through the thickness of each of the second piezoelectric sheets 34 except for the bottom sheet 34. As shown in FIG. 6, each of the internal connection electrodes 42*a* provided in each first piezoelectric sheet 33, and a corresponding one of the internal connection electrodes 42*b* provided in the second piezoelectric sheet 34 adjacent the each first sheet 33 are distant, in their plan view, from each other by an appropriate value, 31, that is, the two electrodes 42*a*, 42*b* are not aligned with each other in their plan view.

Figure 9:
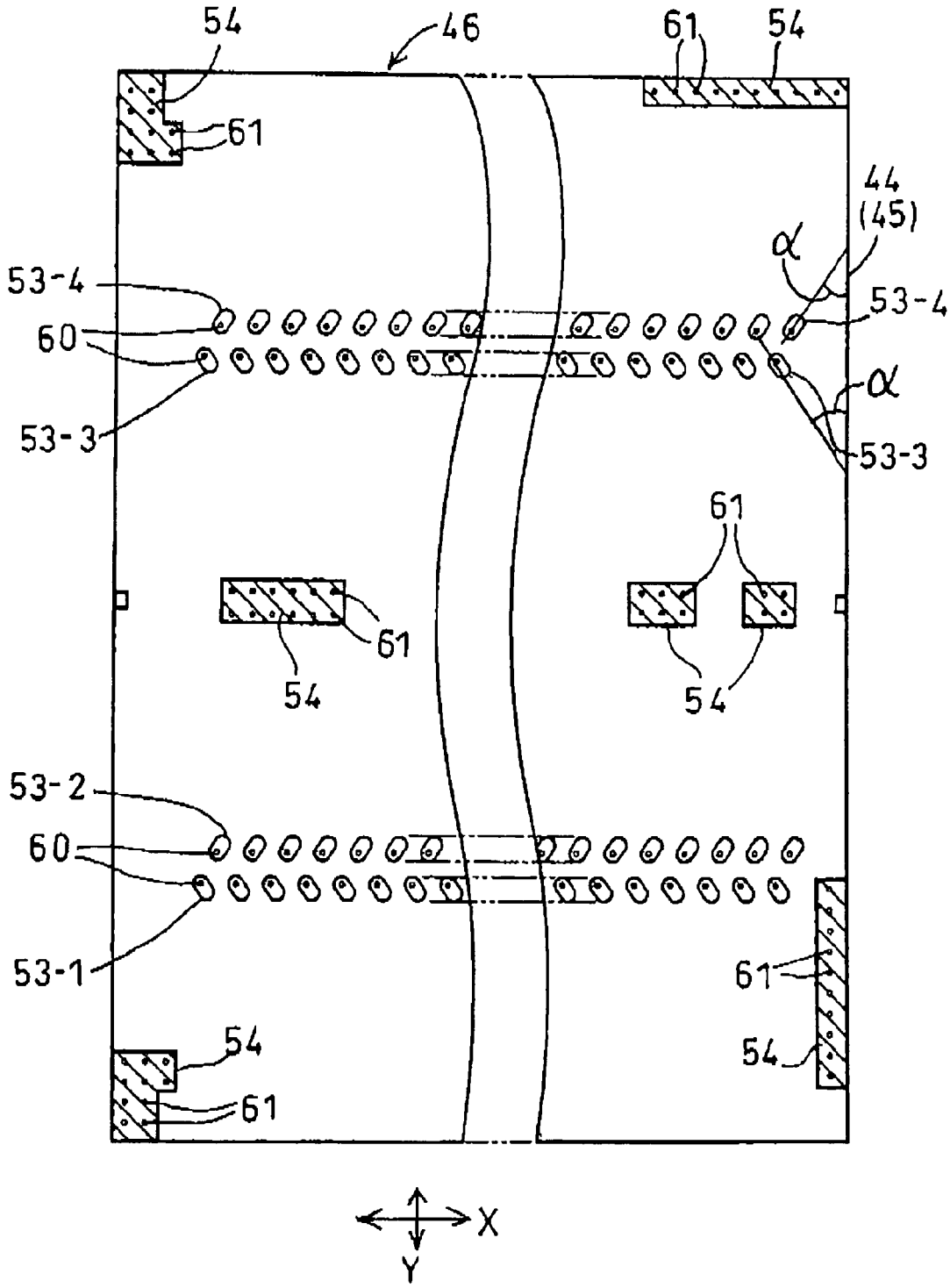
FIG. 9 is an enlarged, plan view of a lower binder sheet of the actuator unit, showing first individual connection members, a portion of the lower binder sheet being cut away.

As shown in FIG. 9, on an upper surface of the lower one 46 of the two binder sheets 46, 47, there are provided first connection electrical conductors 53 each of which has a generally elliptic shape in its plan view and which are arranged in four arrays 53-1, 53-2, 53-3, 53-54, at a certain regular pitch in each array, such that each of the first connection members 53 at least partly overlaps, in its plan view, a corresponding one of the dummy individual electrodes of the four arrays 38-1, 38-2, 38-3, 38-4 provided on each second piezoelectric sheet 34 except for the bottom sheet 34. Each first connection member 53 is inclined, in its plan view, by the acute angle α (e.g., 60 degrees) relative to the straight line defined by the end 44, 45 of each actuator unit 12*a*, 12*b*. The lower binder sheet 46 additionally has, in four corners and central portions of the upper surface thereof, respective connection members 54 each of which partly overlaps, in its plan view, the proper common electrode 37 provided on each second piezoelectric sheet 37. The connection members 54 provide common electrical conductors.

Figure 10:
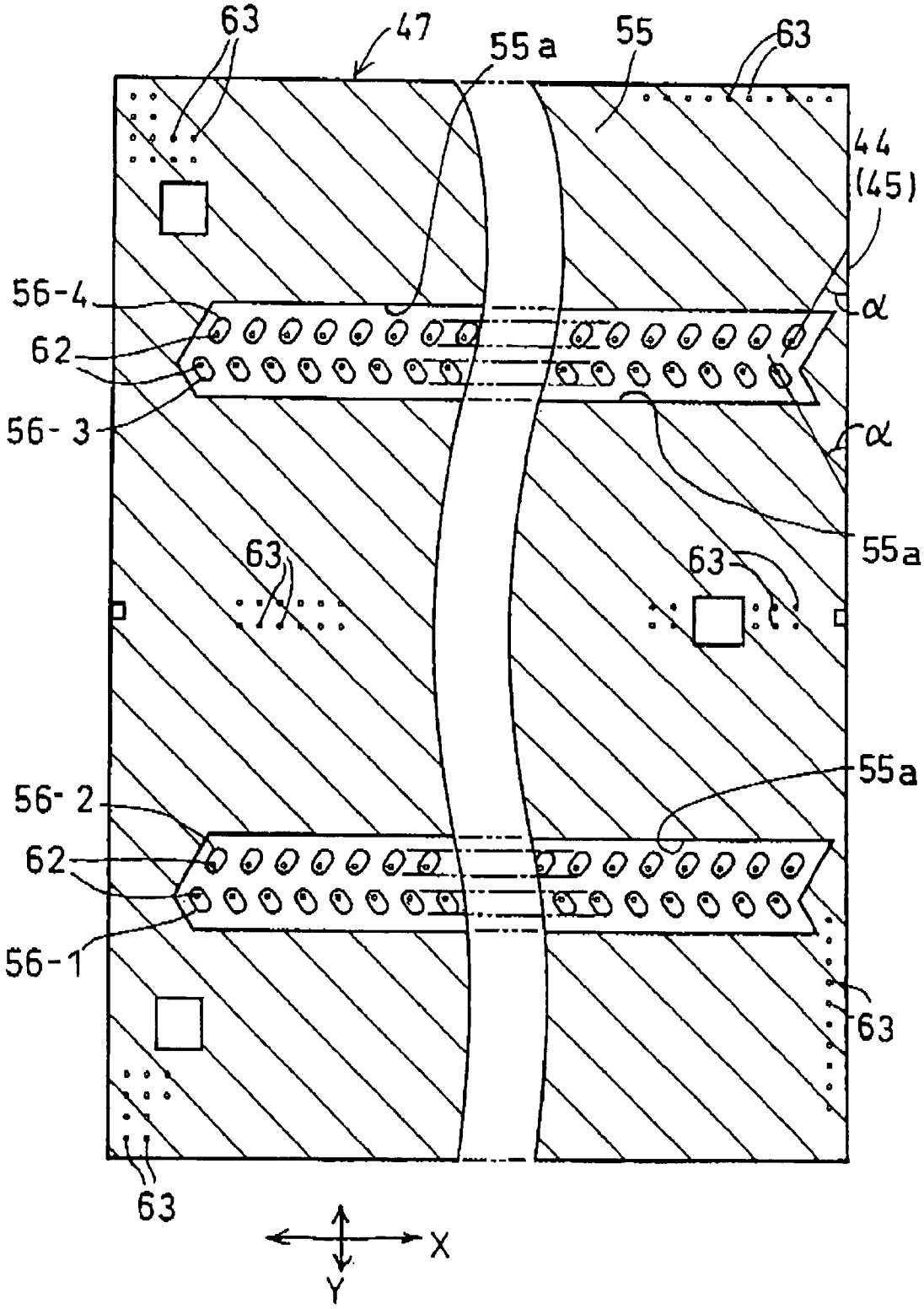
FIG. 10 is an enlarged, plan view of an upper binder sheet of the actuator unit, showing second individual connection members, a portion of the upper binder sheet being cut away.

Meanwhile, as shown in FIG. 10, on an upper surface of the upper binder sheet 47, there are provided a connection member 55 as a common electrical conductor that has, in its plan view, substantially the same size as that of each proper common electrode 37 provided on each second piezoelectric sheet 34, and overlaps the each proper common electrode 37, and second connection members 56 each of which has a generally elliptic shape in its plan view and which are arranged in four arrays 56-1, 56-2, 56-3, 56-54, at a certain regular pitch in each array, such that each of the second connection members 56 at least partly overlaps a corresponding one of the first connection members 53 of the four arrays 53-1, 53-2, 53-3, 53-4 provided on the lower binder sheet 46.

The second connection members 56 will be referred, if appropriate, to as second island-like individual electrical conductors that are isolated from each other on the upper binder sheet 47. The second connection members 56 are electrically connected to the dummy individual electrodes 38 provided on each of the second piezoelectric sheets 34, via internal connection electrodes 62 extending through the thickness of the upper binder sheet 47, the first connection members 53 provided on the lower binder sheet 46, and internal connection electrodes 60 extending through the thickness of the lower sheet 46.

Figure 16:
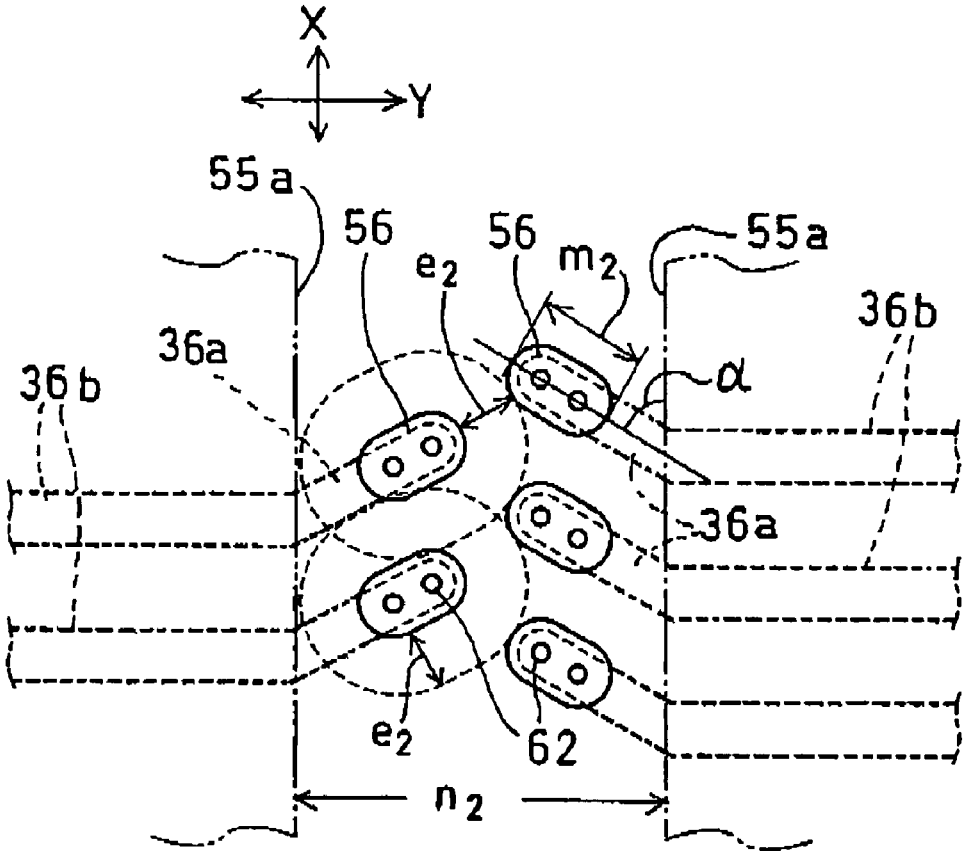
FIG. 16 is an enlarged, plan view for explaining, in more detail, a positional relationship between the second individual connection members and a common connection member shown in FIG. 10.

As shown in FIGS. 10 and 16, each second individual connection member 56 is also inclined, in its plan view, by the acute angle α (e.g., 60 degrees) relative to the straight line defined by the end 44, 45 of each actuator unit 12*a*, 12*b*. In addition, as indicated at two-dot chain line in FIG. 16, a distance between each second individual connection member 56 and a straight edge line 55*a* of the common connection member 55 that is next to the each second individual connection member 56, and a distance between each pair of second individual connection members 56, 56 next to each other in the first direction is selected at the value e2.

Since the second individual connection members 56 are inclined, a lengthwise dimension, m2, of each second individual connection member 56 can be increased, while the distance between the each second individual connection member 56 and the straight edge line 55*a* of the common connection member 55 and the distance between each pair of second individual connection members next to each other in the first direction are each kept at the value e2. In addition, a distance, n2, between the two opposed, straight edge lines-55*a*, 55*a* of the common connection member 55 can be decreased, as shown in FIGS. 10 and 16. Therefore, even if, when the common connection member 55 and the four arrays of second individual connection members 56 are formed by printing, the contour of each member 55 or 56 may be deformed and the area of each member 55, 56 may be somewhat increased or decreased from a nominal value, no electric current leaks between two members 55, 56, or two members 56, 56, next to each other, upon application of electric voltage to the members 55, 56, because the above-indicated distance e2 is kept. Thus, only a desired active portion or portions of the piezoelectric actuator 12 (i.e., the actuator units 12*a*, 12*b*) corresponding to a desired pressure chamber or chambers 23 can be reliably operated, which leads to exhibiting a good printing quality of the printer head 10.

Consequently the short sides of each of the actuator units 12*a*, 12*b*, i.e., the Y-axis-direction dimension of the each actuator unit 12*a*, 12*b* can be decreased, and accordingly the printer head 10 can be advantageously downsized.

Figure 11:
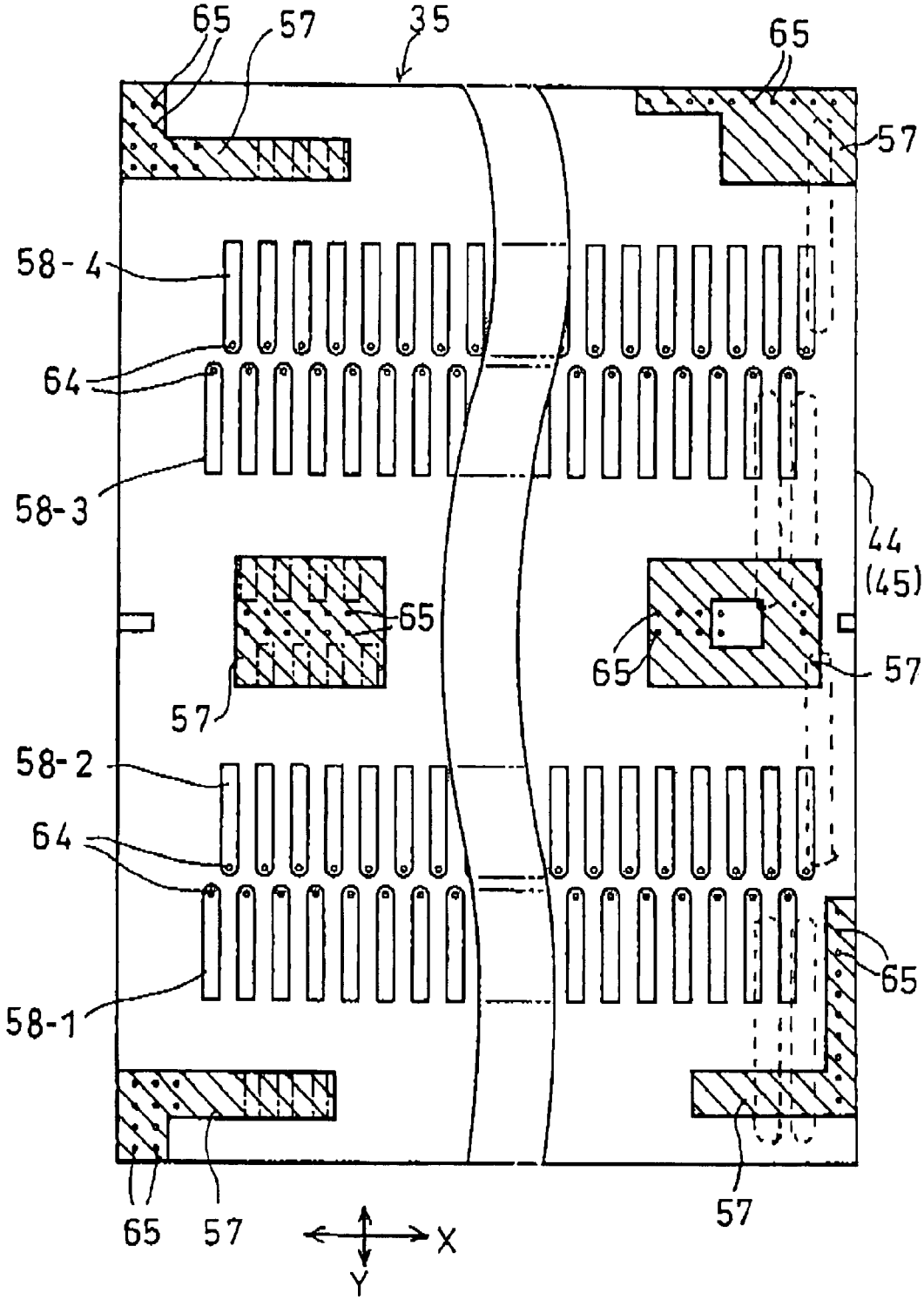
FIG. 11 is an enlarged, plan view of a top sheet of the actuator unit, showing individual conductive members, a portion of the top sheet being cut away.
Figure 14:
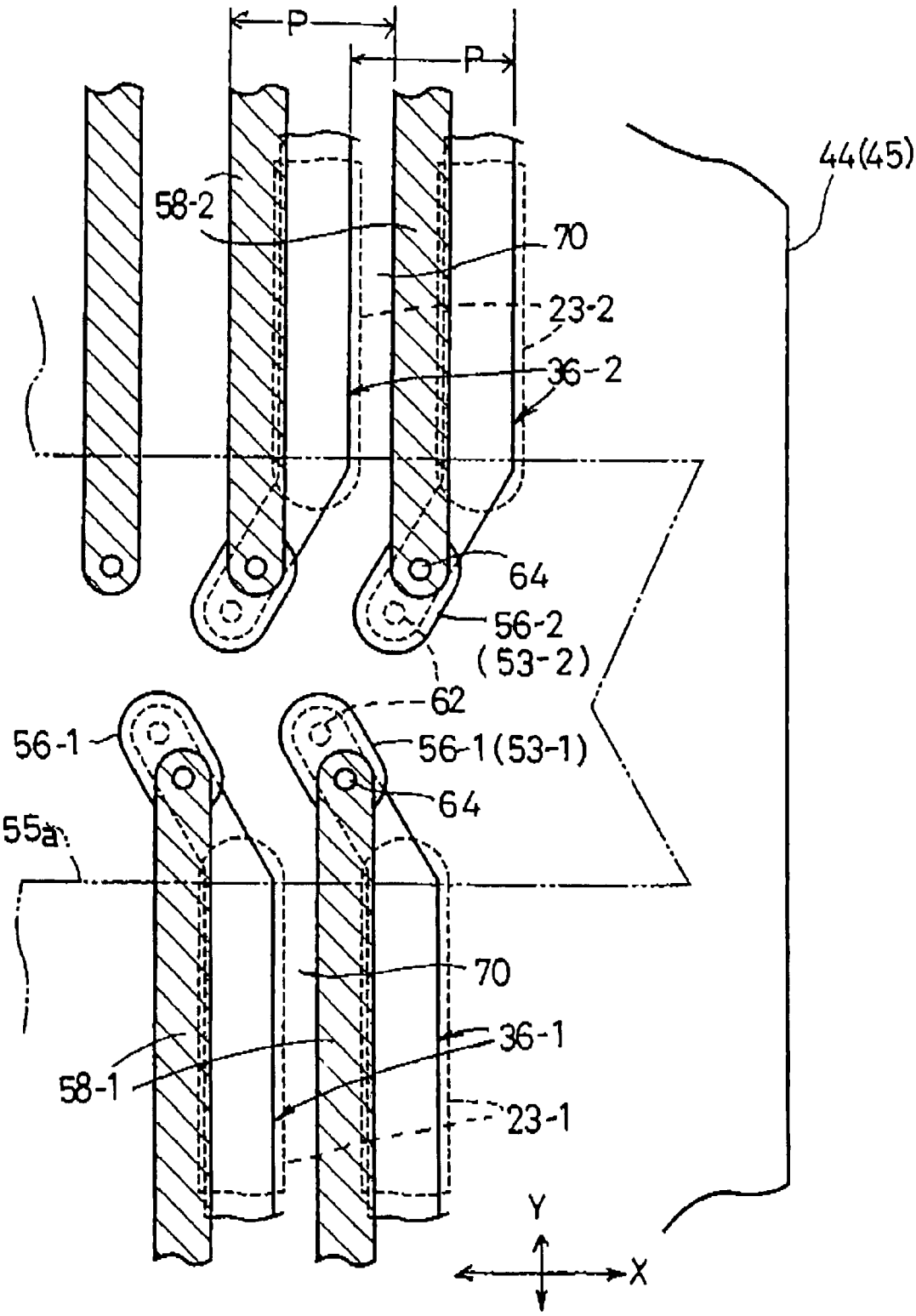
FIG. 14 is an enlarged, plan view of the top sheet of the actuator unit, showing a positional relationship between the proper individual electrode, first and second connection members, and an individual conductive member, and the pressure chamber, a portion of the actuator unit being cut away.
Figure 15:
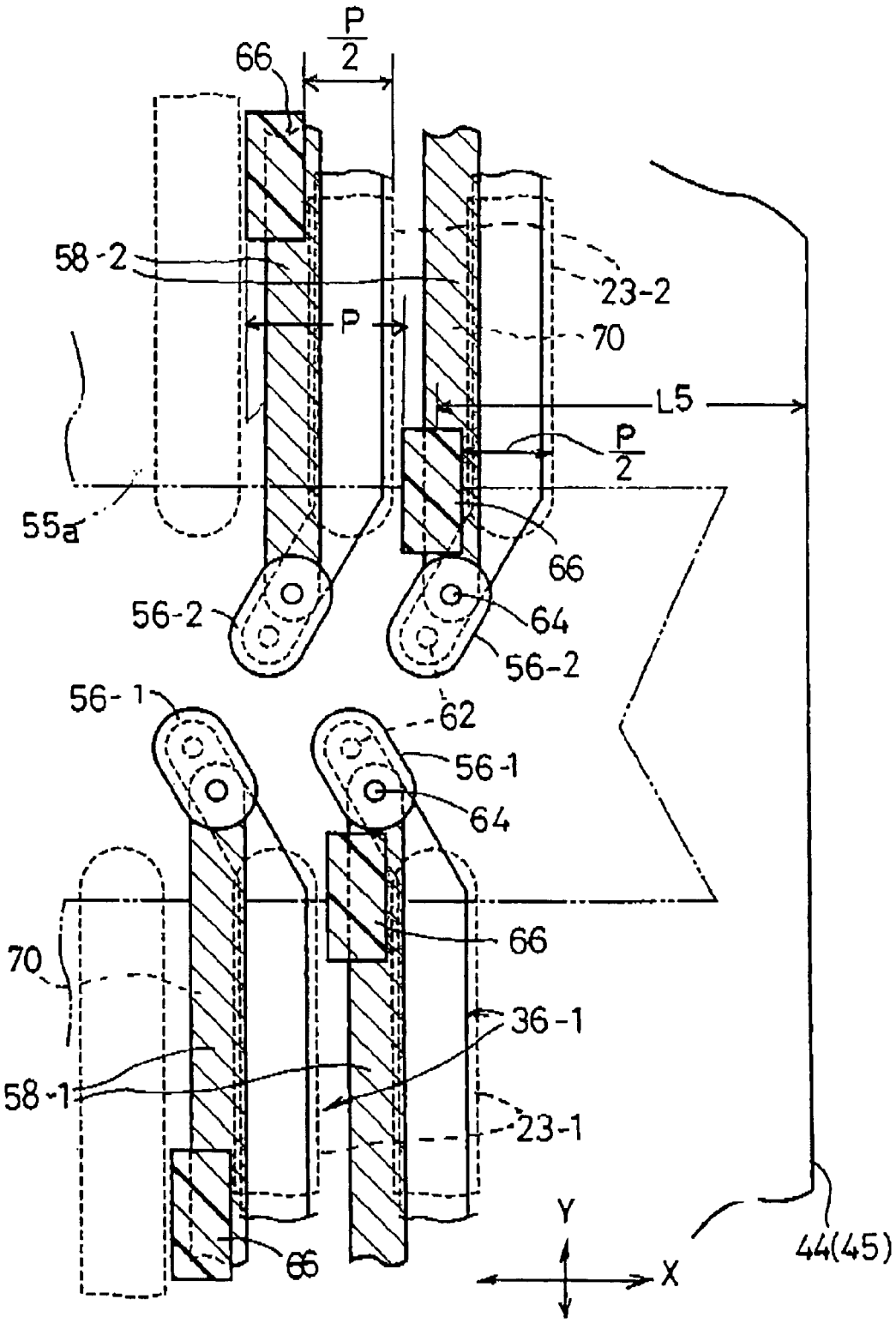
FIG. 15 is an enlarged, plan view of the top sheet of the actuator unit, showing a positional relationship between the proper individual electrode, the individual conductive member, and an individual surface electrode, and the pressure chamber, a portion of the actuator unit being cut away.

As shown in FIG. 11, on an upper surface of the top sheet 35, there are provided a plurality of common electrical conductors 57 each of which partly overlaps, in its plan view, the common connection member 55 provided on the upper binder sheet 47. On the upper surface of the top sheet 35, there are also provided four arrays of individual electrical conductors 58 (58-1, 58-2, 58-3, 58-4) that overlaps, in their plan view, the four arrays of second individual connection members 56 (56-1, 56-2, 56-3, 56-4) provided on the upper binder sheet 47. The individual conductive members 58 of each array are arranged at the pitch P, as shown in FIG. 14. As shown in FIG. 11, each of the individual conductive members 58 (58-1, 58-2, 58-3, 58-4) extends in the Y-axis direction, i.e., in a direction parallel to the short sides of the top sheet 36 or a corresponding one of the proper individual electrodes 36 (36-1, 36-2, 36-3, 36-4). More specifically described, as is apparent from comparison of FIGS. 8 and 11 with each other, each individual conductive member 58 straightly extends parallel to the straight portion 36*b* of the corresponding proper individual electrode 36, such that the each conductive member 58 is shorter than the straight portion 36*b*. Moreover, as shown in FIGS. 14 and 15, each of the individual conductive members 58 (58-1, 58-2, 58-3, 58-4) provided on the upper surface of the top sheet 35 is located right above the partition wall 70 present between two pressure chambers 23 that are located below the each conductive member 58, extend parallel to each other, and are next to each other in the first direction. Though, in the embodiment shown in FIG. 14, the each individual conductive member 58 is somewhat offset from the center of the partition wall 70, the each conductive member 58 may be aligned, in its plan view, with the center of the partition wall 70.

Figure 12:
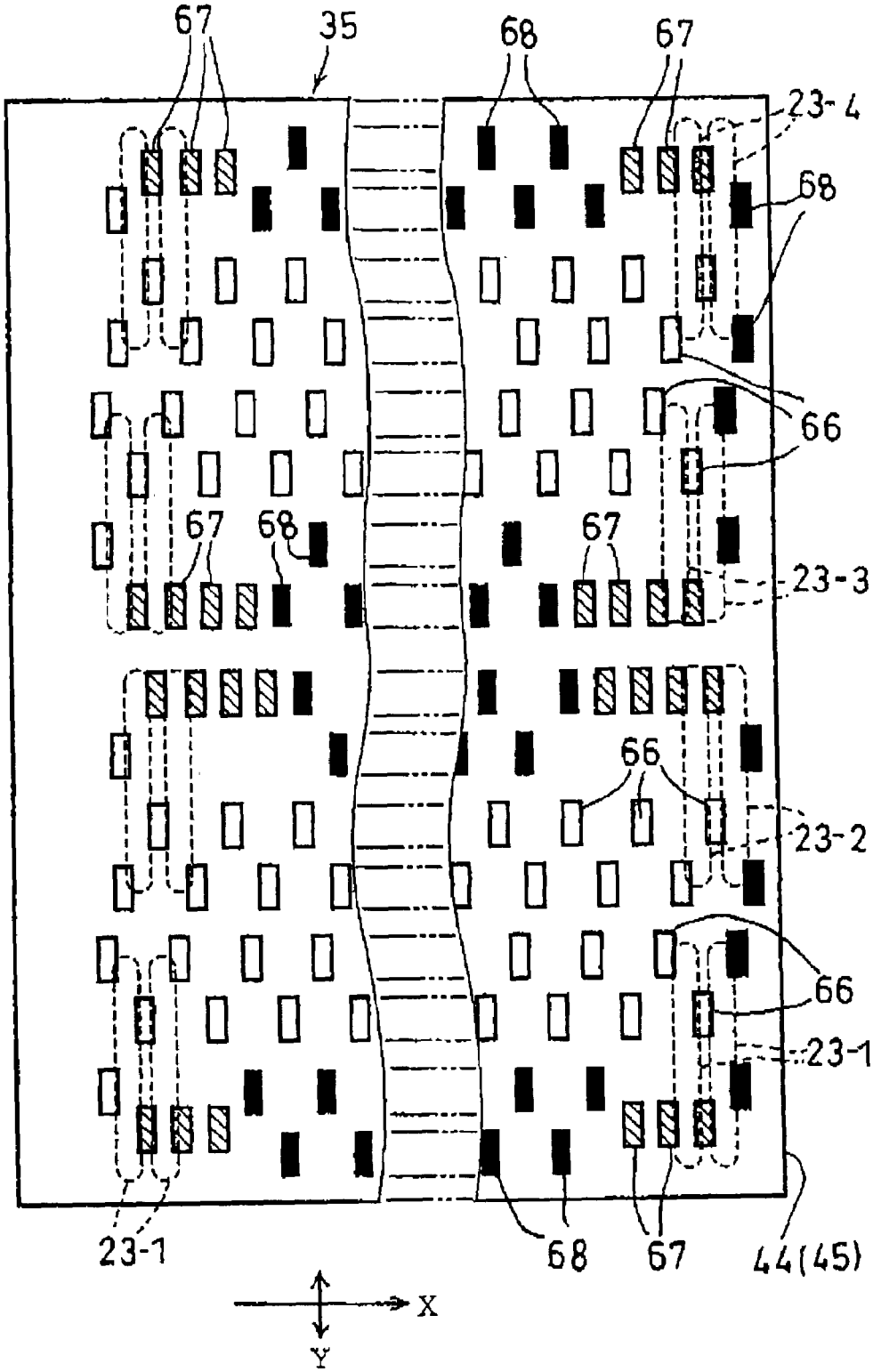
FIG. 12 is an enlarged, plan view of the top sheet of the actuator unit, showing individual surface electrodes, a portion of the top sheet being cut away.

Additionally, as shown in FIG. 12, on the upper surface of the top sheet 35, there are provided four arrays of individual surface electrodes 66, a plurality of common surface electrodes 67, and a plurality of dummy members 68 all of which are rectangular in their plan view and function as after-attached electrodes for being connected to connection electrodes 71 of the flat cable 13 (i.e., the two cable units 13*a*, 13*b*). As shown in FIG. 15, each of the individual surface electrodes 66 only partly overlaps, in its plan view, an appropriate lengthwise portion of a corresponding one of the individual conductive members 58 (58-1, 58-2, 58-3, 58-4) provided on the top sheet 35, and is thus electrically connected to the corresponding conductive member 58, and the individual surface electrodes 66 of each of the four arrays are arranged in a zigzag manner in the X-axis direction, such that each pair of electrodes 66 next to each other in the X-axis direction are distant from each other in the Y-axis direction.

That is, in the embodiment shown in FIG. 15, each of the individual surface electrodes 66 is provided, in its plan view, at a position offset from the corresponding pressure chamber 23 or the corresponding active portion, by half the regular pitch P at which the pressure chambers 23 of each array or the active portions of each array are arranged in the X-axis direction, and simultaneously at a position right above the corresponding partition wall 70 between each pair of pressure chambers 23 next to each other in the X-axis direction. The individual surface electrodes 66 of each array are arranged at the same pitch P as the pitch at which the pressure chambers 23 of each array are arranged in the X-axis direction.

In a modified form of the present embodiment, each of the individual surface electrodes 66 may be provided at a position that is offset from the corresponding pressure chamber 23 or the corresponding active portion, by one and half the pitch P (i.e., 1.5 P) in the X-axis direction, and is right above another partition wall 70.

Moreover, as shown in FIGS. 3 and 15, each of the four arrays of individual surface electrodes 66 of each of the two actuator units 12*a*, 12*b* includes one electrode 66 that is the nearest to a corresponding one of the respective ends 44, 45 of the units 12*a*, 12*b* that are opposed to each other in the X-axis direction. In the present embodiment, a distance, e5, between the respective nearest electrodes 66 of the four arrays of electrodes 66 of the each actuator unit 12*a*, 12*b* and the corresponding one end 44, 45 is greater than the distance L1 between the pressure chambers 23 or active portions corresponding to the nearest electrodes 66, and the corresponding end 44, 45.

The common surface electrodes 67 are also after-attached electrodes each of which only partly overlaps, in its plan view, a corresponding one of the common conductive members 57 provided on the upper surface of the top sheet 35. The dummy members 68 are after-attached members each of which is attached to a portion of a corresponding one of the common conductive members 57 that is extended in the X-axis or Y-axis direction. The common surface electrodes 67 and the dummy members 68 are also located right above the corresponding partition walls 70, as shown in FIG. 12.

As shown in FIG. 9, the lower binder sheet 46 has four arrays of internal connection electrodes 60 that electrically connect, in the vertical direction, between the four arrays of first individual connection members 53-1, 53-2, 53-3, 53-4 provided on the sheet 46, and the four arrays of dummy individual electrodes 38-1, 38-2, 38-3, 38-4. The internal connection electrodes 60 are formed of an electrically conductive material (paste) filling respective through-holes formed through the thickness of the sheet 46.

In addition, as shown in FIG. 9, the lower binder sheet 46 has a plurality of internal connection electrodes 61 that electrically connect, in the vertical direction, between the first individual connection members 54 provided on the sheet 46 and the proper common electrode 37 provided on the piezoelectric sheet 34 underlying the sheet 46. The internal connection electrodes 61 are formed of an electrically conductive material filling respective through-holes formed through the thickness of the sheet 46.

Likewise, as shown in FIG. 10, the upper binder sheet 47 has four arrays of internal connection electrodes 62 that electrically connect between the four arrays of second individual connection members 56-1, 56-2, 56-3, 56-4 provided on the sheet 47, and the four arrays of first individual connection members 53-1, 53-2, 53-3, 53-4 provided on the lower binder sheet 46, respectively; and additionally has a plurality of internal connection electrodes 63 that electrically connect between the common connection members 55 provided on the sheet 47 and the common connection members 54 provided on the lower binder sheet 46. The internal connection electrodes 62, 63 are formed of an electrically conductive material filling respective through-holes formed through the thickness of the upper binder sheet 47.

Also likewise, as shown in FIG. 11, the top sheet 35 has four arrays of internal connection electrodes 64 that electrically connect between the four arrays of individual conductive members 58-1, 58-2, 58-3, 58-4 provided on the sheet 35, and the four arrays of second individual connection electrodes 56-1, 56-2, 56-3, 56-4 provided on the upper binder sheet 47, respectively; and additionally has a plurality of internal connection electrodes 65 that electrically connect between the common conductive members 57 provided on the sheet 35 and the common connection members 55 provided on the underlying upper binder sheet 47. The internal connection electrodes 64, 65 are formed of an electrically conductive material filling respective through-holes formed through the thickness of the top sheet 35.

In the present embodiment, the plurality of groups of internal connection electrodes 42*a*, 42*b*, 60, 62, 64 that connect, in the vertical direction, between the dummy individual electrodes 38 and the proper individual electrodes 36, between the proper individual electrodes 36 and the dummy individual electrodes 38, between the dummy individual electrodes 38 and the first individual connection members 53, between the first individual connection members 53 and the second individual connection members 56, respectively, are provided such that each of the internal connection electrodes of one group 42*a*, 42*b*, 60, 62, 64 is not aligned, in its plan view, with a corresponding one of the internal leads of another group vertically next to the one group.

In the present embodiment, internal connection members that electrically connect between the proper individual electrodes 36 of each of the actuator units 12*a*, 12*b* and the connection electrodes 71 of a corresponding one of the two cable units 13*a*, 13*b* are defined as encompassing not only the dummy individual electrodes (i.e., first internal pads) 38, the first individual connection members (i.e., second internal pads) 53, the second individual connection members (i.e., second internal pads) 56, and the individual conductive members 58 all of which are flat members provided on the respective upper surfaces of the second piezoelectric sheets 34, the lower and upper binder sheets 46, 47, and the top sheet 35, and but also the internal connection electrodes (i.e., internal leads) 42*a*, 42*b*, 60, 62, 64 that are columnar members extending through the respective thickness of the sheets 33, 34, 46, 47, 35.

Next, there will be described an example of a method of manufacturing the piezoelectric actuator 12, i.e., each of the actuator units 12*a*, 12*b*. In this method, the piezoelectric sheets 33, 34, the binder sheets 46, 47, and the top sheet 35 are each formed of a ceramic material. A plurality of operation units of each actuator unit 12*a*, 12*b* are integrally formed, in a matrix, in large-size ceramic green sheets, as follows: First, for each operation unit, the proper individual electrodes 36, the dummy common electrodes 43, the proper common electrodes 37, and the dummy individual electrodes 38 are formed, by screen printing, of an electrically conductive paste such as a silver-palladium-based paste, on the piezoelectric sheets 33, 34, as shown in FIGS. 7 and 8. Likewise, the first individual connection members 53, the common connection members 54, the second individual connection members 56, and the common connection members 55 are formed by screen printing of the electrically conductive paste on the upper and lower binder sheets 46, 47, as shown in FIGS. 9 and 10. Then, the individual conductive members 58 and the common conductive members 57 are formed by screen printing of the electrically conductive paste on the stop sheet 35, as shown in FIG. 11.

The internal connection electrodes 41, 42*a*, 42*b*, 60, 61, 62, 63, 64, 65 embedded in the piezoelectric sheets 33, 34 (except for the bottom sheet 34), the upper and lower binder sheets 47, 46, and the top sheet 35 are formed by casting the above-described paste into the through-holes formed through the respective thickness of the sheets 33, 34, 46, 47, 35. Next, the plurality of sheet members 33, 34, 46, 47, 35 are stacked on each other such that respective portions of the sheet members that are to provide the respective operation units of each actuator unit 12*a*, 12*b* are accurately aligned with each other in the direction of stacking of the sheet members. Subsequently, the sheet members 33, 34, 46, 47, 35 thus stacked on each other are pressed in the stacking direction, and then are fired.

Subsequently, as shown in FIG. 12, the individual surface electrodes 66, the common surface electrodes 67, and the dummy members 68, each of which has a rectangular shape in its plan view and is an after-attached member to be connected to a corresponding one of the connection electrodes 71 of the cable units 13*a*, 13*b*, are formed by screen printing to be thick, and then are dried. Since the surface electrodes 66, 67 are not fired, those electrodes 66, 67 can be well soldered to the connection electrodes 71 of the cable units 13*a*, 13*b*.

An adhesive sheet or layer, not shown, that is formed of a synthetic resin that does not allow permeation of ink is adhered, in advance, to the entire lower surface of each of the sheet-stacked-type actuator units 12*a*, 12*b* constructed as described above, The respective lower surfaces of the actuator units 12*a*, 12*b* are to be opposed to the pressure chambers 23 of the cavity unit 11. Alternatively, a thermosetting adhesive may be applied to the entire lower surface of each actuator unit 12*a*, 12*b*. Then, the two actuator units 12*a*, 12*b* are adhered and fixed to the cavity unit 11, such that the proper individual electrodes 36 of the actuator units 12*a*, 12*b* are aligned with the pressure chambers 23 of the cavity unit 11, respectively, and such that the respective ends 44, 45 of the two actuator units 12*a*, 12*b* are distant from each other by the distance L4, as shown in FIGS. 4A and 3. To this end, in a state in which a planar surface of a jig is held in contact with an upper surface of each actuator unit 12*a*, 12*b*, the jig is pressed to press the each actuator unit 12*a*, 12*b* toward the cavity unit 11. Since the individual and common surface electrodes 66, 67 and the dummy members 68 projecting from the upper surface of each actuator unit 12*a*, 12*b*, are aligned with the partition walls 70 present between the pressure chambers 23, as shown in FIG. 12, the amount of adhesive provided on the partition walls 70 advantageously operates to adhere the each actuator unit 12*a*, 12*b* to the partition walls 70, owing to the pressing force applied to the each unit 12*a*, 12*b* via the individual surface electrodes 66. Thus, the present printer head 10 is freed from the problems that ink leaks because of bad adhesion and that the pressing force is directly applied to the pressure chambers 23 each as a vacant space, and accordingly each pressure chamber 23 is prevented from being deformed and each actuator unit 12*a*, 12*b* is prevented from being cracked.

Then, the two cable units 13*a*, 13*b* are stacked and pressed on the respective upper surfaces of the two actuator units 12*a*, 12*b*, so that the connection electrodes 71 of the cable units 13*a*, 13*b* are electrically connected to the individual surface electrodes 66 and the common surface electrodes 67 of the actuator units 12*a*, 12*b*.

For the same reason as indicated above, that is, since the individual surface electrodes 66 are located right above the partition walls 70 present between the pressure chambers 23, a great force can be applied to press the flexible flat cable units 13*a*, 13*b* to the respective upper surfaces of the actuator units 12*a*, 12*b*, respectively, so that the electric connection between the connection electrodes 71 of the cable units 13*a*, 13*b* and the individual and common surface electrodes 66, 67 of the actuator units 12*a*, 12*b* can be completed.

In the present embodiment, the dummy individual electrodes 38, the first individual connection members 53, the second individual connection members 56, the individual conductive members 58, and the internal connection electrodes 60, 62, 64 for vertically connecting between the dummy individual electrodes 38 and the first connection members 53, between the first connection members 53 and the second connection members 56, and between the second connection members 56 and the individual conductive members 58, are employed to connect between the individual surface electrodes 66 provided on the upper surface of the uppermost or top sheet 35 of each actuator unit 12*a*, 12*b*, and the proper individual electrodes 36. Since the respective end portions 36*a* of the proper individual electrodes 36 are inclined, it is easy to design each actuator unit 12*a*, 12*b* such that the electrodes and members 38, 53, 56, 58, 60, 62, 64 thereof are distant from the end 44, 45 thereof in the X-axis direction, and accordingly it is easy to locate the individual surface electrodes 66 thereof at the respective positions largely distant from the end 44, 45 thereof. Therefore, the two cable units 13*a*, 13*b* can be located relative to each other, such that the sufficiently great distance L4 is provided therebetween, and accordingly the cable units 13*a*, 13*b* are prevented from interfering with each other.

In addition, since the individual surface electrodes 66 are attached to the respective individual conductive members 58 after the conductive members 58 have been fired, as shown in FIG. 15, it is possible to design the positions where the individual surface electrodes 66 are provided, such that those positions are more distant from the end 44, 45, within an appropriate range, in the X-axis direction in which the arrays of nozzles 24 extend. Thus, in the present embodiment, the distance L5 between the individual surface electrodes 66 provided on the respective individual conductive members 58 formed on the upper surface of each of the two actuator units 12*a*, 12*b* that are arranged in series in the X-axis direction, and a corresponding one of the respective ends 44, 45 of the two units 12*a*, 12*b*, is greater than the distance L1 between the active portions of the each actuator unit 12*a*, 12*b* and the corresponding end 44, 45. Therefore, even if a distance between an edge line of each cable unit 13*a*, 13*b* and the connection electrodes 71 of the same 13*a*, 13*b* may be great as conventional, the two cable units 13*a*, 13*b* can be bonded to the two actuator units 12*a*, 12*b*, respectively, such that the two cable units 13*a*, 13*b* do not interfere with each other at the location where the respective ends 44, 45 of the two actuator units 12*a*, 12*a* are opposed to each other.

Thus, in the present embodiment, the individual and common surface electrodes 66, 67 provide external pads of the piezoelectric actuator 12 (i.e., the two actuator units 12*a*, 12*b*); and the individual conductive members 58 provide part of the internal connection members, as described above. However, the individual and common surface electrodes 66, 67 may be omitted. In the latter case, the connection electrodes 71 of the cable units 13*a*, 13*b* may directly be connected to the individual conductive members 58 and the common conductive members 57 that are exposed in the upper surface of the top sheet 35. In the latter case, the individual and common conductive members 58, 57 provide the external pads of the piezoelectric actuator 12.

In the ink jet printer head 10 constructed as described above, when a high electric voltage suitable for polarization is applied to all the individual electrodes 36 and all the common electrodes 37 of each actuator unit 12*a*, 12*b* via the individual surface electrodes 66 and the common surface electrodes 67 thereof respective portions of the piezoelectric sheets 33, 34 that are sandwiched by the individual and common electrodes 36, 37 are polarized. The thus polarized portions of the piezoelectric sheets 33, 34, sandwiched by the individual and common electrodes 36, 37, provide the active portions of the each actuator unit 12*a*, 12*b*. In addition, when a drive electric voltage is applied to desired individual electrodes 36 and the common electrodes 37 via corresponding individual surface electrodes 66 and the common surface electrodes 67, so as to produce an electric field parallel to the direction of polarization of the corresponding active portion, the active portion is elongated in the direction of stacking of the piezoelectric sheets 33, 34 and accordingly the volume of the corresponding pressure chamber 23 is decreased, so that a droplet of ink is ejected from the pressure chamber 23 via the corresponding nozzle 24 and a desired image is printed on a recording medium such as a sheet of paper.

The present ink jet printer head 10 may be used as a full-color printer head that uses four color inks, i.e., black, cyan, yellow, and magenta inks. In this case, for example, the first array of nozzles 24-1 are used to eject the black ink; the second array of nozzles 24-2 are used to eject the cyan ink; the third array of nozzles 24-3 are used to eject the yellow ink; and the fourth array of nozzles 24-4 are used to eject the magenta ink. In addition, the first array of manifolds 26 formed in the manifold sheets 18, 19 and corresponding to the first array of nozzles 24-1 are filled with the black ink; the second array of manifolds 26 corresponding to the second array of nozzles 24-2 are filled with the cyan ink; and the third array of manifolds 26 corresponding to the third array of nozzles 24-3 are filled with the yellow ink; and the fourth array of manifolds 26 corresponding to the fourth array of nozzles 24-4 are filled with the magenta ink. Each array of manifolds consists of two manifold chambers 26, as described above.

In the illustrated embodiment, all the pressure chambers 23 are grouped into the two groups that are arranged in the first direction in which the pressure chambers 23 are arranged in the four arrays, and the great distance L2 is provided between the two groups of pressure chambers 23. In addition, at least one of the communication passages 25 that communicate with each of the pressure chambers 23 and with a corresponding one of the nozzles 24 is provided in the form of the bottomed groove 50 extending substantially parallel to the plane defined by at least one sheet member 21–15 in which the groove 50 is formed. Therefore, the printer head 10 can be manufactured to have an increased number of nozzles 24 without decreasing the pitch at which the nozzles 24 are arranged, because the printer head 10 employs the two actuator units 12*a*, 12*b* such that the two units 12*a*, 12*b* are arranged in the first direction and each of the units 12*a*, 12*b* is shorter, in the first direction, than a corresponding one of the two groups of pressure chambers 23.

Thus, the amount of shrinkage of each actuator unit 12*a*, 12*b* caused by firing thereof decreases, and accordingly the variation of a distance between each pair of active portions next to each other, from respective distances between other pairs of active portions, also decreases. Consequently actuator units 12*a*, 12*b* having accurate dimensions can be manufactured with high efficiency.

If there is known such an ink jet printer head that has 75 nozzles or pressure chambers arranged in an array within the length of one inch, a new ink jet printer head which has a 2-inch or 3-inch long array of nozzles can be easily produced by employing two or three piezoelectric actuators each of which is used in the known ink jet printer head.

Even if the respective outlet ends 23*a* of two pressure chambers 23 next to each other may be too near to the corresponding nozzles 24 in the plan view of the cavity unit 11, it is possible to curve the plan-view shape of the bottomed groove 50 formed along the upper or lower surface of the third spacer sheet 21, and thereby connect the thus curved groove 50 to the vertical communication passages 25 communicating with the corresponding nozzle 24. Thus, the present printer head enjoys the increased degree of freedom of design.

In the illustrated embodiment, the ink jet printer head 10 has the four arrays of nozzles 24. However, the principle of the present invention can be applied to any sort of printer head that has at least one array of nozzles. In addition, the present invention can be applied to a printer head employing a single piezoelectric actuator and a single cable member that are fixed to each other.

In the illustrated embodiment, the length of each of the external pads 66 is smaller than the length of each of the partition walls 70. Therefore, the piezoelectric actuator 12 (12*a*, 12*b*) can have the increased number of external pads 66 on the outer surface of the outermost sheet member 35.

In addition, in the illustrated embodiment, the piezoelectric actuator 12 (12*a*, 12*b*) includes the plurality of electrical conductors 58 which are formed, by printing and firing, on the outer surface of the outermost sheet member 35 of the piezoelectric actuator 12, and the external pads 66 are subsequently formed, by printing, on the electrical conductors 58, respectively. Since the external pads 66 are subsequently formed on the outer surface of the outermost sheet member 35 of the piezoelectric actuator 12, the external pads 66 can be so selected as to be able to exhibit a high degree of bonding with respect to the cable member 13 (13*a*, 13*b*). In addition, the degree of freedom of designing about where the external pads 66 are located can be increased.

In addition, in the illustrated embodiment, the internal leads 64 extend through the thickness of the outermost sheet member 35 of the piezoelectric actuator 12 (12*a*, 12*b*), the electrical conductors 58 are electrically connected to the individual electrodes 36 via the internal leads 64, respectively, and extend parallel to the pressure chambers 23, respectively, in the Y direction (FIG. 12) perpendicular to the X direction, and the external pads 66 are formed on the outer surface of the outermost sheet member 35 of the piezoelectric actuator 12, such that each of the external pads 66 partly overlaps a corresponding one of the electrical conductors 58. Therefore, the degree of freedom of designing about where the electrical conductors 58 are located and where the external pads 66 are located can be increased.

In addition, in the illustrated embodiment, each of the individual electrodes 36 which are aligned with the pressure chambers 23, respectively, includes the end portion 36*a* which is electrically connected to a corresponding one of the internal leads 64, is inclined relative to the remaining portion 36*b* of the each individual electrode 36, and is extended to the position which is offset outward from a corresponding one of the pressure chambers 23 in the Y direction perpendicular to the X direction and which is aligned with a corresponding one of the external pads 66 in the direction of stacking of the sheet members 33, 34, 35, 46, 47. Therefore, each of the individual electrodes 36 overlaps a corresponding one of the pressure chambers 23 and a corresponding one of the active portions and, in this state, a corresponding one of the internal leads 64, 42 formed through the thickness of an appropriate sheet member 35, 33, 34 can be located at a position that is offset from the one pressure chamber 23 or the one active portion. Therefore, each of the external pads 66 can be easily located at an appropriate position offset from the one pressure chamber 23 or the one active portion.

In addition, in the illustrated embodiment, the nozzles 23 of the cavity unit 11 are arranged in four arrays, and the active portions of the piezoelectric actuator 12 (12*a*, 12*b*) are arranged in four arrays respectively corresponding to the four arrays in which the nozzles 23 are arranged. Therefore, the full-color ink jet printer head 10 can be produced in a small size.

In addition, in the illustrated embodiment, the external pads 66 of each actuator portion 12*a*, 12*b* are arranged in at least one array at a predetermined regular interval of distance in the X direction. Therefore, it is possible to employ the commercially available flat cables 13*a*, 13*b* each of which has a plurality of connection portions arranged at a regular interval of distance.

In addition, in the illustrated embodiment, the internal leads 64 of each actuator portion 12*a*, 12*b* are formed in the respective through-holes formed through the thickness of the outermost sheet member 35 of the each actuator portion 12*a*, 12*b*. Therefore, the internal leads 64 can be easily provided in each of the actuator portions 12*a*, 12*b*, which leads to increasing largely the degree of freedom of designing about where the internal leads 64 and the external pads 66 are located.

In addition, in the illustrated embodiment, the sheet members 33, 34, 46, 47, 35 include the outer sheet member 47 which is stacked on at least one piezoelectric sheet 33, 34, and the piezoelectric actuator 12 (12*a*, 12*b*) includes the common electrical conductor 55 which has the shape substantially identical with the shape of at least one common electrode 37, is electrically connected to the common electrode 37, and is provided on one of opposite planar surfaces of the outer sheet member 47, such that the common electrical conductor 55 is elongate in the X direction and has the second edge line 55*a* parallel to the X direction; the plurality of second internal leads 62 which extend through the thickness of the outer sheet member 47; and the plurality of second internal pads 56 which are electrically connected to the first internal pads 38 via the second internal leads 62, respectively, and which are provided on the one planar surface of the outer sheet member 47, such that each of the second internal pads 56 is distant from the second edge line 65*a* of the common electrical conductor 55 by the second predetermined distance e2 in the Y direction, and extends in the fourth direction inclined by the second predetermined angle relative to the Y direction. Since the second internal pads 56 are inclined, the length of each second internal pad 56 can be increased, while the distance e2 between the each second internal pad 56 and the edge line 55*a* of the common electrical conductor 55 is kept. Therefore, even it, when the common electrical conductor 55 and the second internal pads 56 are formed by printing, the contour of each of the conductor 55 and/or the pads 56 may be deformed and the area of the same 55, 56 may be somewhat increased or decreased from a nominal value, no electric current leaks between two pads 56 next to each other, upon application of electric voltage to the same 56, because the distance e2 is kept. Thus, only the desired active portion or portions of the piezoelectric actuator 12 (12*a*, 12*b*) corresponding to the desired pressure chamber or chambers 23 can be reliably operated, which leads to exhibiting a good printing quality of the printer head 10.

In addition, in the illustrated embodiment, the first internal pads 38 are distant from each other by the predetermined distance e2 in the X direction, and the second internal pads 56 are distant from each other by the predetermined distance e2 in the X direction. Therefore, no electric current leaks between two internal pads 38, or 56, next to each other, upon application of electric voltage to the same. Thus, only the desired active portion or portions of the piezoelectric actuator 12 (12*a*, 12*b*) corresponding to the desired pressure chamber or chambers 23 can be reliably operated, which leads to exhibiting a good printing quality of the printer head 10. In addition, the printer head 10 can be reduced in size.

In addition, in the illustrated embodiment, the nozzles 23 of the cavity unit 11 are arranged in the plurality of arrays which are distant from each other by a predetermined distance in the Y direction, the pressure chambers 23 are arranged in the plurality of arrays which are distant from each other by the predetermined distance in the Y direction, at least one common electrode 37 has the two first edge lines 37*d*1 which extend in the X direction and are distant from each other in the Y direction, and the first internal pads 38 are provided in the area between the two first edge lines 37*d*1, and the common electrical conductor 55 has the two second edge lines 55*a* which extend in the X direction and are distant from each other in the Y direction, and the second internal pads 56 are provided in the area between the two second edge lines 55*a*. Therefore, the dimension of the piezoelectric actuator 12 (12*a*, 12*b*) in the Y direction can be decreased.

Next, there will be described a second embodiment of the present invention by reference to FIGS. 18 through 23. The second embodiment also relates to an ink jet printer head. The second ink jet printer head has a construction basically identical with that of the first ink jet printer head 10 shown in FIG. 1. Therefore, the same reference numerals as used in the foregoing description of the first printer head 10 shown in FIGS. 1 to 17 are used to designate the corresponding elements and parts of the second printer head shown in FIGS. 18 to 23, and the description thereof is omitted. Hereinafter, there will be described only differences between the two printer heads. That is, a cavity unit 11 of the second printer head employs a third spacer sheet 121 in place of the third spacer sheet 21 of the cavity unit 11 of the first printer head 10, and a piezoelectric actuator 12 (i.e., each of two actuator units 12*a*, 12*b*) of the second printer head employs proper common electrodes 137 in place of the proper common electrodes 37 of each actuator unit 12*a*, 12*b* of the first printer head 10.

Figure 18:
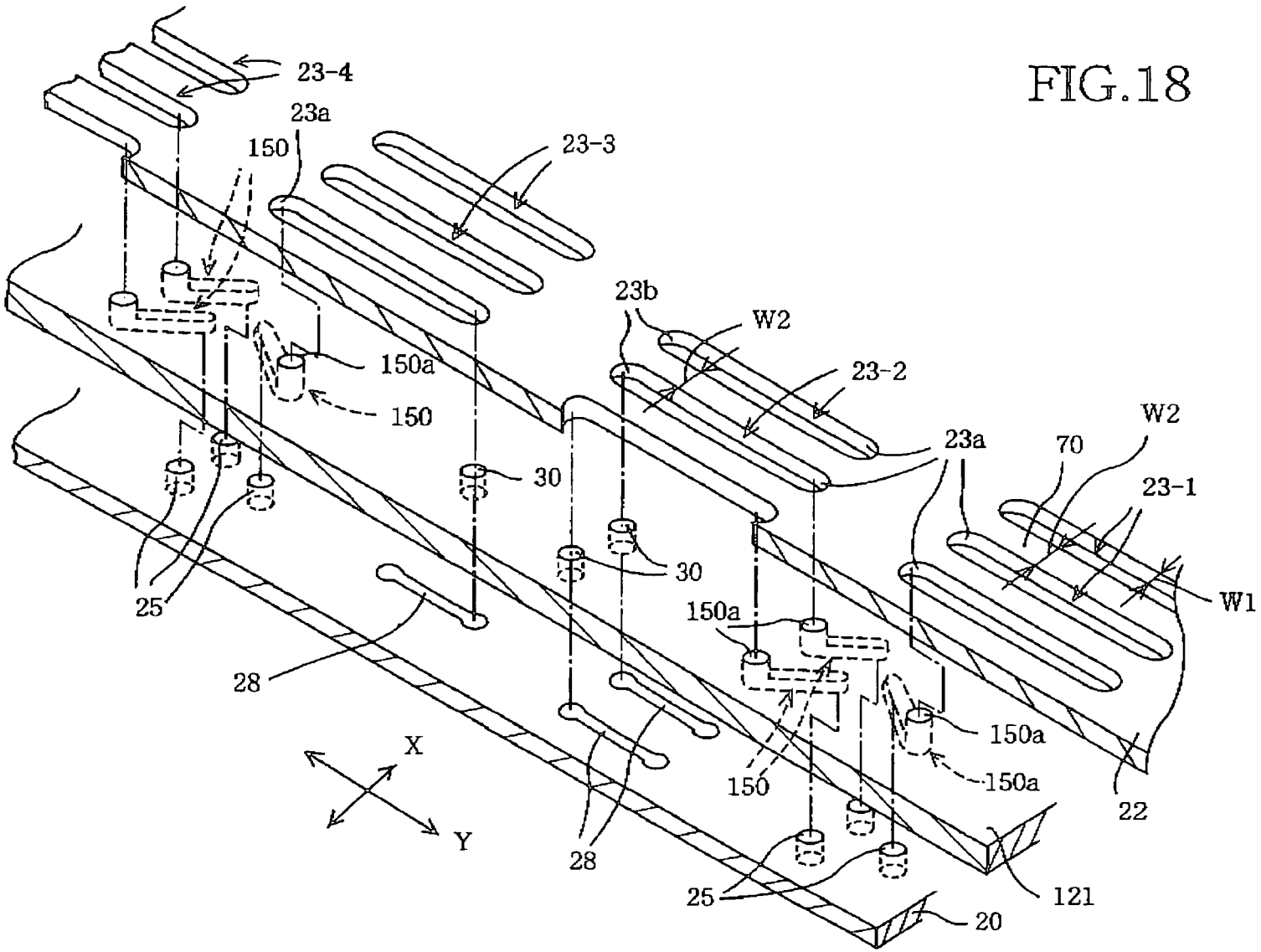
FIG. 18 is a perspective, exploded view corresponding to FIG. 2, showing a portion of a cavity unit of another ink jet printer head as a second embodiment of the present invention.
Figure 23:
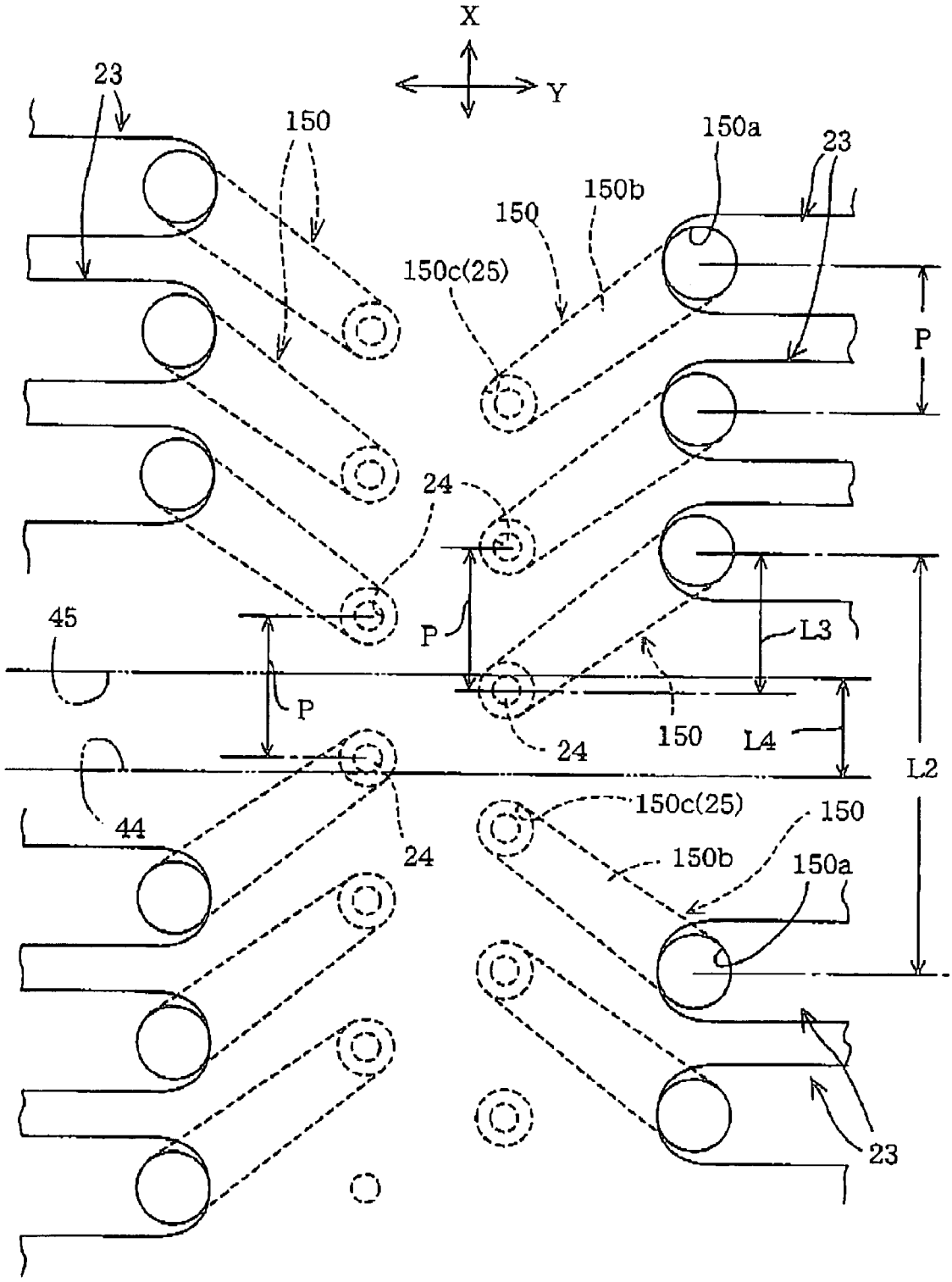
FIG. 23 is an enlarged, plan view of the cavity unit shown in FIG. 18, showing a positional relationship between pressure chambers and bottomed grooves.

In the second embodiment, the cavity unit 11 includes the third spacer sheet 121 that contacts a lower surface of the base sheet 22 having the four arrays of pressure chambers 23 (23-1, 23-2, 23-3, 23-4), as shown in FIG. 18. The third spacer sheet 121 has four arrays of bottomed grooves 150 corresponding to the four arrays of pressure chambers 23, respectively. As shown in FIGS. 18, 19, and 23, each of the bottomed grooves 150 has one end 150*a* that opens in an upper surface of the third spacer sheet 121 and communicates with an outlet end 23*a* of a corresponding one of the pressure chambers 23; a bottomed horizontal portion 150*b* that opens in a lower surface of the third spacer sheet 121; and an other end 150*c* that communicates with an upper end of a corresponding one of the vertical communication passages 26 of the second spacer sheet 20 underlying the third sheet 121. Since each bottomed groove 150 is formed in the lower surface of the third spacer sheet 121, it may be called a "topped" groove.

Figure 20:
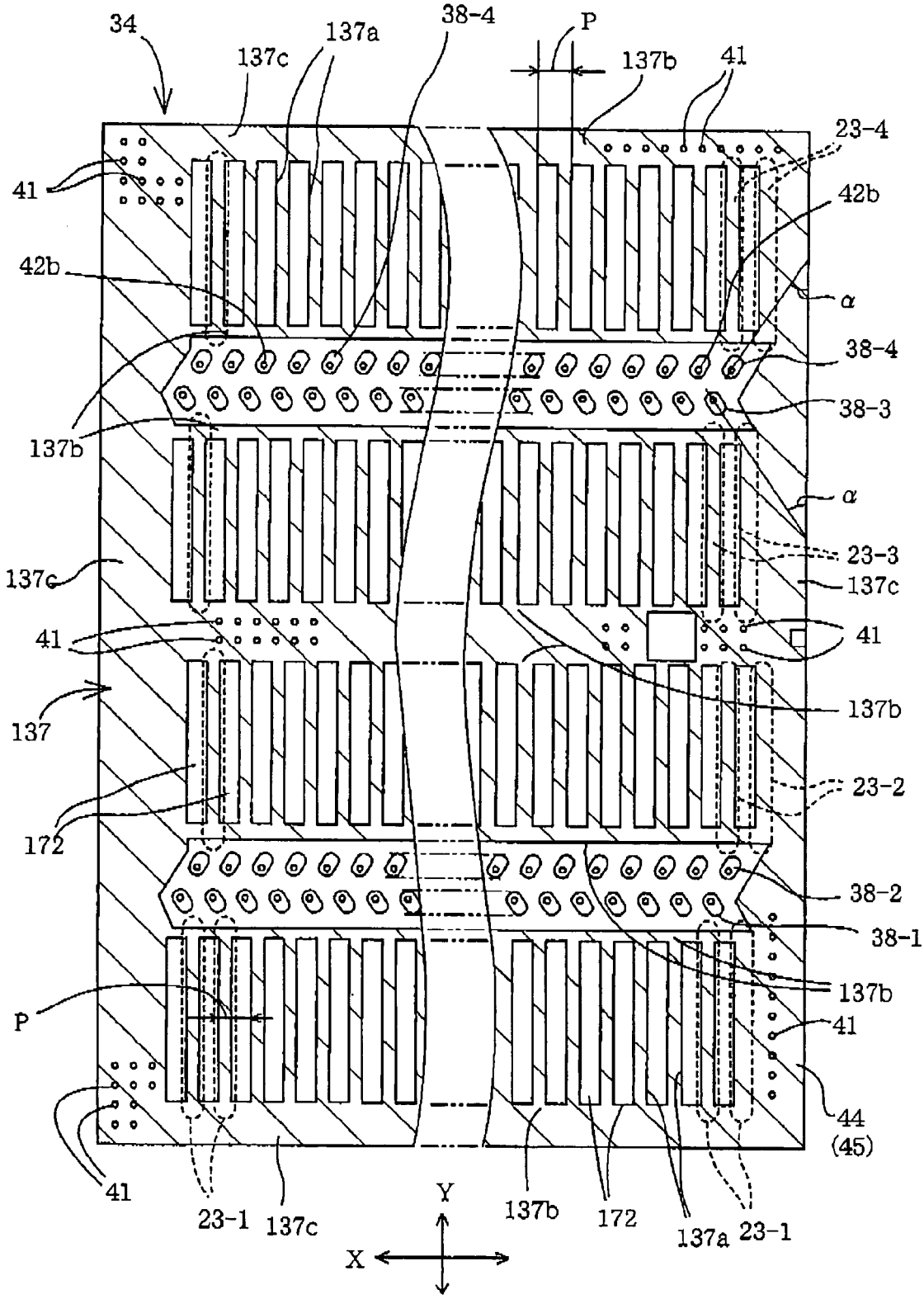
FIG. 20 is an enlarged, plan view corresponding to FIG. 7, sowing a piezoelectric sheet of one of two actuator units of the piezoelectric actuator shown in FIG. 19.
Figure 21:
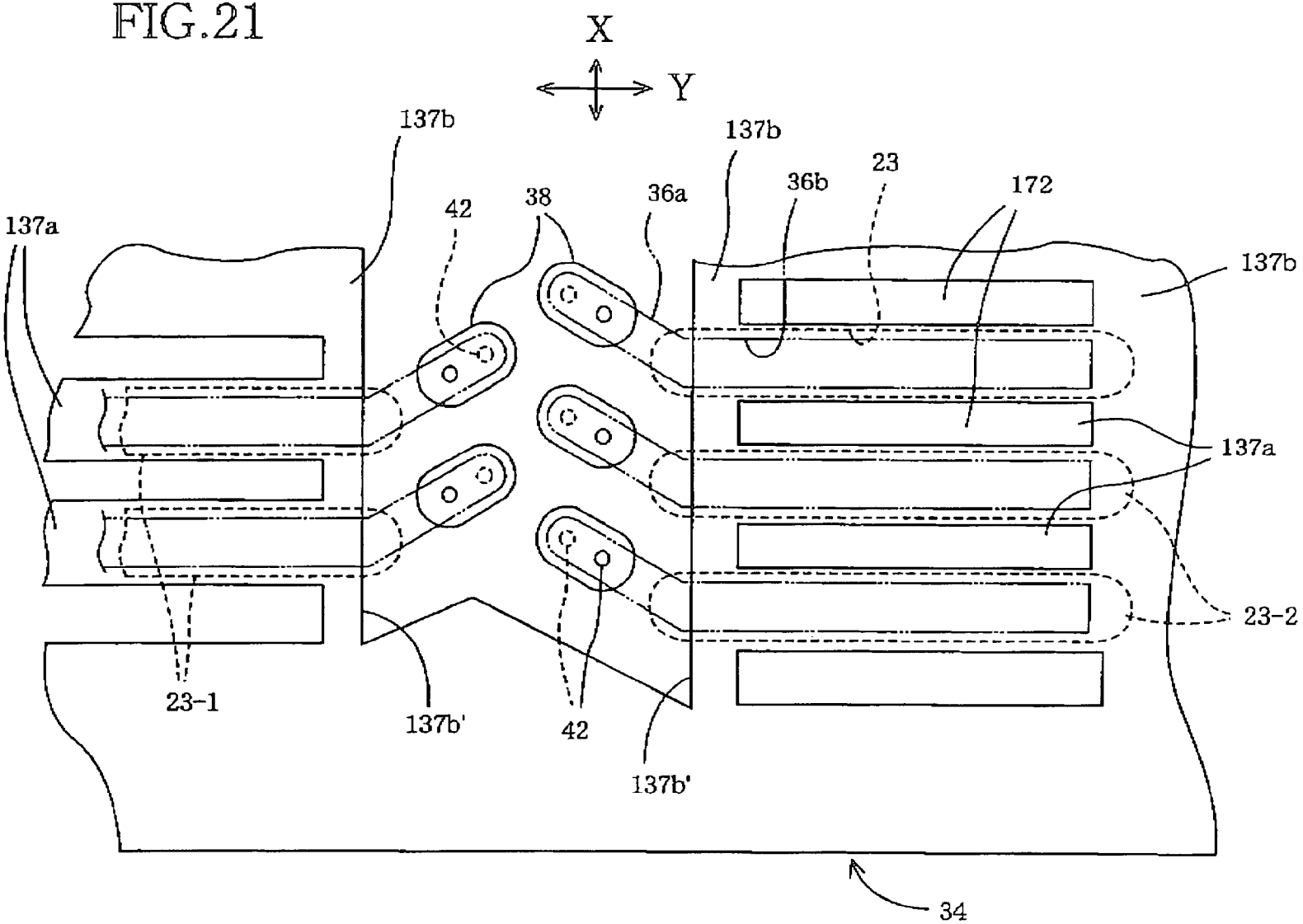
FIG. 21 is an enlarged, plan view corresponding to FIG. 17, showing a proper common electrode and dummy individual electrodes of the actuator unit of the piezoelectric actuator shown in FIG. 19.

The proper common electrodes 137 are formed, by printing, on the respective upper surfaces of the second piezoelectric sheets 34, as shown in FIGS. 20 and 21. Each of the proper common electrodes 137 includes four arrays of individual electrically conductive portions 137*a* that overlap, in their plan view, the four arrays of pressure chambers 23-1, 23-2, 23-3, 23-4, respectively, and the four arrays of proper individual electrodes 36-1, 36-2, 36-3, 36-4, respectively, and are elongate in the Y-axis direction, i.e., in the lengthwise direction of the pressure chambers 23 or the respective straight portions 36*b* of the proper individual electrodes 36. Each proper common electrode 137 additionally includes eight common electrically conductive portions 137*b* that electrically connect, in the first direction or the X-axis direction, respective opposite ends of the individual electrically conductive portions 137*a* of the four arrays that correspond to the respective opposite ends 23*a*, 23*b* of the pressure chambers 23 of the four arrays. More specifically described, a first one of the eight common conductive portions 137*b* electrically connects the respective one ends of the first conductive portions 137*a* of the first array corresponding to the pressure chambers of the first array 23-1; and a second one of the eight common conductive portions 137*b* electrically connects the respective other ends of the first conductive portions 137*a* of the first array. Likewise, the third and fourth common conductive portions 137*b* electrically connect the respective opposite ends of the individual conductive portions 137*a* of the second array corresponding to the pressure chambers of the second array 23-2; the fifth and sixth common conductive portions 137*b* electrically connect the respective opposite ends of the individual conductive portions 137*a* of the third array corresponding to the pressure chambers of the third array 23-3; and the seventh and eighth common conductive portions 137*b* electrically connect the respective opposite ends of the individual conductive portions 137*a* of the fourth array corresponding to the pressure chambers of the fourth array 23-4. The structure of each proper common electrode 137 will be described in more detail by reference to FIG. 20. Each of the individual conductive portions 137*a* has a rectangular shape in its plan view, and has a lengthwise dimension substantially equal to that of each pressure chamber 23. Each of the common conductive portions 137*b* connects the respective one (or other) ends of the individual conductive portions 137*a*, at the respective positions right above the respective lengthwise one (or other) ends 23*a*, 23*b* of the pressure chambers 23, and extends in the X-axis direction in which the arrays of pressure chambers extend. Therefore, each proper common electrode 137 has four arrays of strip-like openings 172 that are defined by the individual and common conductive portions 137*a*, 137*b* and are located right above the four arrays of partition walls 70 present among the four arrays of pressure chambers 23.

Each proper common electrode 137 additionally includes a rectangular, peripheral, electrically conductive portion 137*c* including two long portions along the two long sides of the piezoelectric sheet 34, and two short portions along the two short sides of the same 34. The individual and common conductive portions 37*a*, 37*b* are integrally connected to the peripheral conductive portion 137*c*. The individual conductive portions 137*a* of each of the four arrays are arranged at the same pitch P as the pitch at which the proper individual electrodes of each array 36-1, 36-2, 36-3, 36-4 are arranged, i.e., the pressure chambers 23 of each array are arranged, as shown in FIG. 20.

Figure 22:
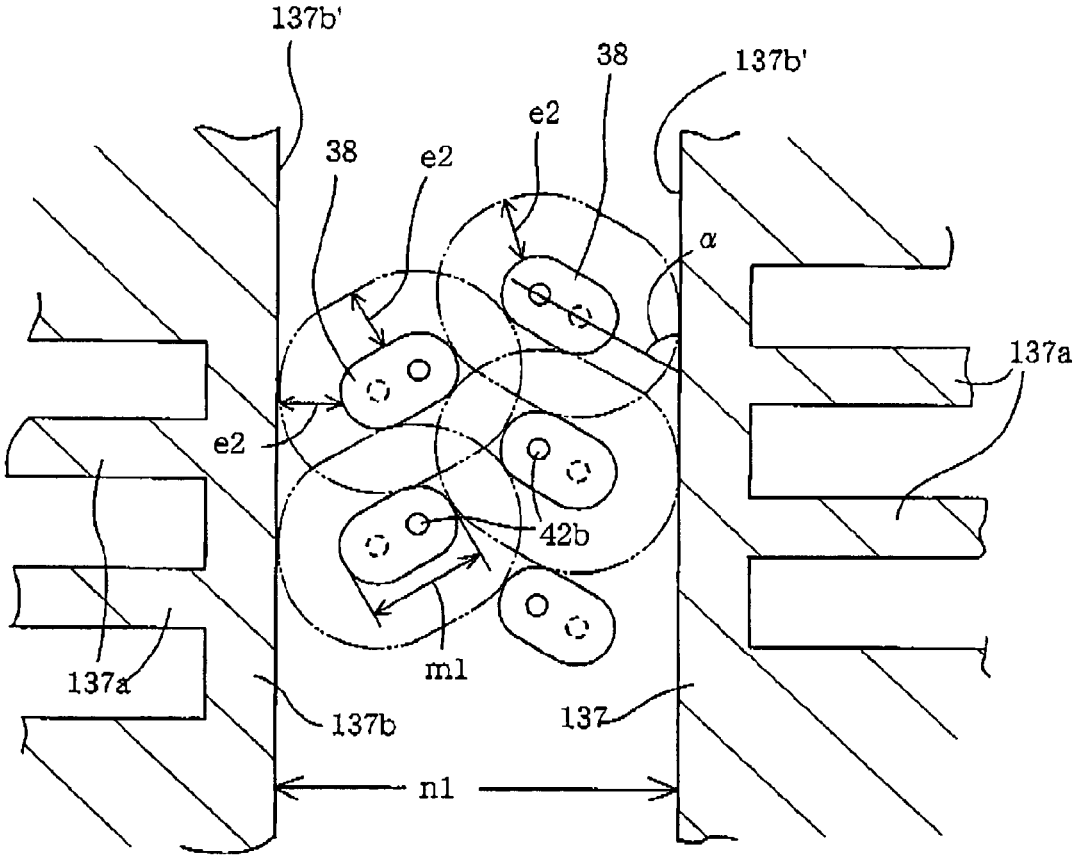
FIG. 22 is an enlarged, plan view for explaining, in more detail, the proper common electrode and the dummy individual electrodes shown in FIG. 20.

As shown in FIG. 22, between respective edge lines 137*b*' of the first and second common conductive portions 137*b* of each proper common electrode 137 provided on the corresponding second piezoelectric sheet 34, there are provided first and second arrays of generally elliptic dummy individual electrodes 38-1, 38-2 that correspond to the first and second arrays of pressure chambers 23-1, 23-2; and between respective edge lines 137*b*' of the third and fourth common conductive portions 137*b* of the each proper common electrode 137, there are provided third and fourth arrays of generally elliptic dummy individual electrodes 38-3, 38-4 that correspond to the third and fourth arrays of pressure chambers 23-3, 23-4. The dummy individual electrodes 38 of each array are arranged at a certain regular pitch in the first direction in which the arrays of pressure chambers 23 or the arrays of proper individual electrodes 36 extend, such that each of the dummy individual electrodes 38 at least partly overlaps, in its plan view, not the straight portion 36*b*, but the end portion 36*a*, of a corresponding one of the proper individual electrodes 36. Each elliptic dummy individual electrode 38 extends, in its plan view, in the same direction as the direction in which the end portion 36*a* of the corresponding proper individual electrode 36 extends. In other words, each dummy individual electrode 38 and the end portion 36*a* of the corresponding proper individual electrode 36 are inclined, in their plan view, by the acute angle $\alpha$ (e.g., 60 degrees) relative to the straight line defined by the end 44, 45 of each actuator unit 12*a*, 12*b*.

As indicated at two-dot chain line in FIG. 22, a distance between each dummy individual electrode 38 and the edge line 137*b*' of the common conductive portion 137*b* corresponding to the each electrode 38, and a distance between each pair of dummy individual electrodes 38 next to each other in the first direction is selected at the value e2.

Since the dummy individual electrodes 38 are inclined, the lengthwise dimension m1 of each dummy electrode 38 can be increased, while the distance between the each dummy electrode 38 and the edge line 137*d*' of the common conductive portion 137*d* and the distance between each pair of dummy electrodes 38 next to each other are each kept at the value e2. In addition, the distance n1 between the edge line 137*d*' of one common conductive portion 137*d* and the edge line 137*d*' of another common conductive portion 137*d* opposed to the one conductive portion 137*d* can be decreased, as shown in FIGS. 20 and 22. Therefore, even if, when the proper common electrode 137 and the four arrays of dummy individual electrodes 38 are formed by printing, the contour of each electrode 137, 38 may be deformed and/or the area of each electrode 137, 38 may be somewhat increased or decreased from a nominal value, no electric current leaks between two common and individual electrodes 137, 38, or between two individual electrodes 38, 38, next to each other, upon application of electric voltage to the electrodes 137, 38, because the above-indicated distance e2 is kept. Thus, only a desired active portion or portions of the piezoelectric actuator 12 (i.e., the actuator units 12*a*, 12*b*) corresponding to a desired pressure chamber or chambers 23 can be reliably operated, which leads to exhibiting a good printing quality of the present printer head. Consequently the short sides of each actuator unit 12*a*, 12*b*, i.e., the Y-axis-direction dimension of the same 12*a*, 12*b* can be shortened or decreased and accordingly the printer head can be downsized.

Meanwhile, each proper common electrode 137 has the strip-like openings 172 located right above the partition walls 70 of the cavity unit 11. Therefore, in contrast to the conventional piezoelectric actuator in which each common electrode covers a substantially entire upper surface of a corresponding piezoelectric sheet, the amount of highly electrically conductive electrode material, such as silver-palladium-based paste, used to form each proper common electrode 137 in the present printer head gradually decreases in proportion to the increase of the total number of ejection nozzles 24 or pressure chambers 23. Thus, the cost of manufacturing of each actuator unit 12*a*, 12*b* can be reduced.

In addition, since the electrically conductive area of each proper common electrode 137 is smaller than the conventional common electrode, an electrostatic capacity or capacitance of each actuator unit 12*a*, 12*b* is smaller than that of the conventional piezoelectric actuator. Therefore, an electric voltage (i.e., a drive voltage) applied to each actuator unit 12*a*, 12*b* to eject ink can be lowered and accordingly a low-drive-voltage circuit board can be employed. Thus, the cost of manufacturing of each actuator unit 12*a*, 12*b* can be reduced.

Moreover, in contrast to the case where only respective one ends of the individual conductive portions 137*a* of each array are connected by a single common conductive portion 137*b*, like teeth of a comb, an electric current can flow, upon application of an electric voltage to each actuator unit 12*a*, 12*b* of the present printer head, through respective entire lengths of the individual conductive portions 137*a* of each array via the two common conducive portions 137*b*, 137*b*, such that the fall of the electric voltage is minimum. Therefore, each of the active portions of each actuator unit 12*a*, 12*b* can be deformed, owing to piezoelectric effect, by a uniform amount over its entire length. In addition, the fall of the electric voltage along each array of individual conductive portions 137*a* is minimized. Thus, the respective ink ejecting performances of the nozzles 24 of each array can be leveled and stabilized.

In addition, since each pressure chamber 23 is surrounded by the two individual conductive portions 137*a* and the pressure chambers 23 of each array are surrounded by the two common conductive portions 137*b*, a degree of flatness of each actuator unit 12*a*, 12*b* that is formed of the green sheets stacked on each other can be improved.

In the second embodiment, in the cavity unit 11, the nozzles 24 (or the pressure chambers 23) are arranged in the plurality of arrays and, in the piezoelectric actuator 12 (12*a*, 12*b*), the common electrode 37 surrounds the first internal pads 38 connected to the individual electrodes 36, and the common electrical conductor 55 connected to the common electrode 37 surrounds the second internal pads 56 connected to the first internal pads 38. Therefore, the flat cable 13 (13*a*, 13*b*) which transmits the external drive signals to the piezoelectric actuator 12 can be connected to the connection portions 66 of the planar surface of the outer sheet element 35 provided on the piezoelectric sheets 33, 34. Thus, the dimension of the piezoelectric actuator 12 in the Y direction (i.e., the widthwise direction of the actuator 12) can be decreased.

It is to be understood that the present invention may be embodied with other changes and improvements that may occur to a person skilled in the art, without departing from the spirit and scope of the invention defined in the claims.

What is claimed is:

1. An ink jet printer head, comprising:

a cavity unit having a plurality of nozzles arranged in a reference direction, a plurality of pressure chambers which communicate with the nozzles, respectively, and a plurality of partition walls which separate the pressure chambers from each other;

a piezoelectric actuator having a plurality of active portions each of which is driven to change a pressure of an ink accommodated in a corresponding one of the pressure chambers, and thereby eject, from a corresponding one of the nozzles, a droplet of the ink, the cavity unit and the piezoelectric actuator being fixed to each other;

the piezoelectric actuator comprising a plurality of sheet members which are stacked on each other and include at least one piezoelectric sheet; at least one common electrode; and at least one individual-electrode layer including a plurality of individual electrodes which are aligned with the pressure chambers, respectively, and each of which cooperates with a corresponding one of a plurality of portions of said at least one common electrode to sandwich a corresponding one of a plurality of portions of said at least one piezoelectric sheet, in a direction of stacking of the sheet members, and thereby provide a corresponding one of the active portions of the piezoelectric actuator;

the piezoelectric actuator further comprising a plurality of external pads which are provided on an outer surface of an outermost sheet member of the sheet members and are electrically connected to a cable member through which drive signals for said active portions are transmitted; and a plurality of internal leads which electrically connect between the individual electrodes and the external pads, respectively; and the external pads being located, on the outer surface of the outermost sheet member of the piezoelectric actuator, at respective positions that are at least partially aligned with the partition walls each of which is located between corresponding two pressure chambers of the plurality of pressure chambers in said reference direction.

2. The printer head according to claim 1, wherein the internal leads of the piezoelectric actuator are formed in respective through-holes formed through a thickness of the outermost sheet member.

3. The printer head according to claim 1, wherein a length of each of the external pads is smaller than a length of each of the partition walls.

4. The printer head according to claim 1, wherein the piezoelectric actuator further comprises a plurality of electrical conductors which are formed on the outer surface of the outermost sheet member of the piezoelectric actuator, and wherein the external pads are formed on the electrical conductors, respectively.

5. The printer head according to claim 4, wherein the electrical conductors are formed, by printing and firing, on the outer surface of the outermost sheet member of the piezoelectric actuator, and wherein the external pads are subsequently formed, by printing, on the electrical conductors, respectively.

6. The printer head according to claim 4, wherein the internal leads extend through a thickness of the outermost sheet member of the piezoelectric actuator, wherein the electrical conductors are electrically connected to the individual electrodes via the internal leads, respectively, and extend parallel to the pressure chambers, respectively, in a direction perpendicular to the reference direction, and wherein the external pads are formed on the outer surface of the outermost sheet member of the piezoelectric actuator, such that each of the external pads partly overlaps a corresponding one of the electrical conductors.

7. The printer head according to claim 1, wherein each of the individual electrodes which are aligned with the pressure chambers, respectively, includes an end portion which is electrically connected to a corresponding one of the internal leads, is inclined relative to a remaining portion of said each individual electrode, and is extended to a position which is offset outward from a corresponding one of the pressure chambers in a direction perpendicular to the reference direction and which is aligned with a corresponding one of the external pads in the direction of stacking of the sheet members.

8. The printer head according to claim 7, wherein the remaining portion of said each individual electrode comprises a straight portion which is connected to the end portion thereof and which extends parallel to said one pressure chamber in said direction perpendicular to the reference direction and is aligned with said one pressure chamber.

9. The printer head according to claim 1, wherein the nozzles of the cavity unit are arranged in four arrays, and wherein the active portions of the piezoelectric actuator are arranged in four arrays respectively corresponding to the four arrays in which the nozzles are arranged.

10. An ink jet printer head, comprising:

a cavity unit having a plurality of nozzles arranged in a reference direction, and a plurality of pressure chambers which communicate with the nozzles, respectively, and which are grouped into at least two groups of pressure chambers each group of which consists of at least two pressure chambers arranged in the reference direction;

a piezoelectric actuator having a plurality of active portions each of which is driven to change a pressure of an ink accommodated in a corresponding one of the pressure chambers, and thereby eject, from a corresponding one of the nozzles, a droplet of the ink, the cavity unit and the piezoelectric actuator being fixed to each other;

the piezoelectric actuator comprising at least two actuator portions each of which has a plurality of active portions and which are arranged next to each other in the reference direction such that respective one ends of said at least two actuator portions are opposed to each other in the reference direction, and such that said at least two actuator portions are opposed to said at least two groups of pressure chambers, respectively;

said each of said at least two actuator portions comprising a plurality of sheet members which are stacked on each other and include at least one piezoelectric sheet; at least one common electrode; and at least one individual-electrode layer including a plurality of individual electrodes which are aligned with said at least two pressure chambers of a corresponding one of said at least two groups of pressure chambers, respectively, and each of which cooperates with a corresponding one of a plurality of portions of said at least one common electrode to sandwich a corresponding one of a plurality of portions of said at least one piezoelectric sheet, in a direction of stacking of the sheet members, and thereby provide a corresponding one of the active portions of said each actuator portion;

said each of said at least two actuator portions further comprising a plurality of external pads which are provided on an outer surface of an outermost sheet member of the sheet members, such that the external pads are arranged in the reference direction, and are electrically connected to a flat cable; and a plurality of internal leads which electrically connect between the individual electrodes and the external pads, respectively; and one of the external pads of said each actuator portion that is nearest to said one end of said each actuator portion in the reference direction being more distant from said one end than one of the active portions of said each actuator portion that is nearest to said one end.

11. The printer head according to claim 10, wherein the external pads of said each actuator portion are arranged in at least one array at a predetermined regular interval of distance in the reference direction.

12. The printer head according to claim 10, wherein the internal leads of said each actuator portion are formed in respective through-holes formed through a thickness of the outermost sheet member of said each actuator portion.

13. The printer head according to claim 10, wherein said each actuator portion further comprises a plurality of electrical conductors which are formed on the outer surface of the outermost sheet member of said each actuator portion, and wherein the external pads of said each actuator portion are formed on the electrical conductors, respectively.

14. The printer head according to claim 13, wherein the electrical conductors are formed, by printing and firing, on the outer surface of the outermost sheet member of said each actuator portion, and wherein the external pads of said each actuator portion are subsequently formed, by printing, on the electrical conductors, respectively.

15. The printer head according to claim 10, wherein the nozzles of the cavity unit are arranged in four arrays, and wherein the active portions of said each actuator portion are arranged in four arrays respectively corresponding to the four arrays in which the nozzles are arranged.

16. An ink jet printer head, comprising:

a cavity unit having a plurality of nozzles arranged in a first direction, and a plurality of pressure chambers which communicate with the nozzles, respectively;

a piezoelectric actuator having a plurality of active portions each of which is driven to change a pressure of an ink accommodated in a corresponding one of the pressure chambers, and thereby eject, from a corresponding one of the nozzles, a droplet of the ink, the cavity unit and the piezoelectric actuator being fixed to each other;

the piezoelectric actuator comprising a plurality of sheet members which are stacked on each other and include at least one piezoelectric sheet; at least one common electrode; and at least one individual-electrode layer including a plurality of individual electrodes which are aligned with the pressure chambers, respectively, and each of which cooperates with a corresponding one of a plurality of portions of said at least one common electrode to sandwich a corresponding one of a plurality of portions of said at least one piezoelectric sheet, in a direction of stacking of the sheet members, and thereby provide a corresponding one of the active portions of the piezoelectric actuator;

said at least one common electrode being provided on one of opposite planar surfaces of said at least one piezoelectric sheet, such that said at least one common electrode is elongate in the first direction and has a first edge line parallel to the first direction; and the piezoelectric actuator further comprising a plurality of first internal leads which extend through a thickness of said at least one piezoelectric sheet; and a plurality of first internal pads which are electrically connected to the individual electrodes via the first internal leads, respectively, and which are provided on said one planar surface of said at least one piezoelectric sheet, such that each of the first internal pads is distant from the first edge line of said at least one common electrode by a first predetermined distance in a second direction perpendicular to the first direction, and extends in a third direction inclined by a first predetermined angle relative to the second direction.

17. The ink jet printer head according to claim 16, wherein said at least one common electrode includes a plurality of first electrically conductive portions each of which at least partly overlaps a corresponding one of the pressure chambers and is elongate in the second direction, and additionally including at least one second electrically conductive portion which extends in the first direction to connect respective one ends of the first conductive portions.

18. The ink jet printer head according to claim 16, wherein the sheet members further comprises an outer sheet member which is stacked on said at least one piezoelectric sheet, and wherein the piezoelectric actuator further comprises a common electrical conductor which has a shape substantially identical with a shape of said at least one common electrode, is electrically connected to said at least one common electrode, and is provided on one of opposite planar surfaces of the outer sheet member, such that the common electrical conductor is elongate in the first direction and has a second edge line parallel to the first direction; and a plurality of second internal leads which extend through a thickness of the outer sheet member; and a plurality of second internal pads which are electrically connected to the first internal pads via the second internal leads, respectively, and which are provided on said one planar surface of the outer sheet member, such that each of the second internal pads is distant from the second edge line of the common electrical conductor by a second predetermined distance in the second direction, and extends in a fourth direction inclined by a second predetermined angle relative to the second direction.

19. The ink jet printer head according to claim 18, wherein each of the first and second predetermined angles is an acute angle relative to the second direction, and wherein the third and fourth directions are parallel to each other.

20. The ink jet printer head according to claim 18, wherein each of the first and second internal pads has an elliptical shape.

21. The ink jet printer head according to claim 18, further comprises at least one third internal lead which extends through a thickness of the outer sheet member and which electrically connects between the common electrical conductor and said at least one common electrode.

22. The ink jet printer head according to claim 18, wherein the first internal pads are distant from each other by the first predetermined distance in the first direction, and the second internal pads are distant from each other by the second predetermined distance in the first direction.

23. The ink jet printer head according to claim 18, wherein the nozzles of the cavity unit are arranged in a plurality of arrays which are distant from each other by a third predetermined distance in the second direction, and the pressure chambers are arranged in a plurality of arrays which are distant from each other by a fourth predetermined distance in the second direction, wherein said at least one common electrode has two said first edge lines which extend in the first direction and are distant from each other in the second direction, and the first internal pads are provided in an area between the two first edge lines, and wherein the common electrical conductor has two said second edge lines which extend in the first direction and are distant from each other in the second direction, and the second internal pads are provided in an area between the two second edge lines.

24. The ink jet printer head according to claim 16, wherein the nozzles of the cavity unit are arranged in four arrays, and wherein the active portions of the piezoelectric actuator are arranged in four arrays respectively corresponding to the four arrays in which the nozzles are arranged.

25. An ink jet printer head, comprising:

a cavity unit having a plurality of nozzles arranged in a first direction, and a plurality of pressure chambers which communicate with the nozzles, respectively, and each of which is elongate in a second direction perpendicular to the first direction;

a piezoelectric actuator having a plurality of active portions each of which is driven to change a pressure of an ink accommodated in a corresponding one of the pressure chambers, and thereby eject, from a corresponding one of the nozzles, a droplet of the ink, the cavity unit and the piezoelectric actuator being fixed to each other;

the piezoelectric actuator comprising a plurality of sheet members which are stacked on each other and include at least one piezoelectric sheet; at least one common electrode; and at least one individual-electrode layer including a plurality of individual electrodes which are aligned with the pressure chambers, respectively, and each of which cooperates with a corresponding one of a plurality of portions of said at least one common electrode to sandwich a corresponding one of a plurality of portions of said at least one piezoelectric sheet, in a direction of stacking of the sheet members, and thereby provide a corresponding one of the active portions of the piezoelectric actuator;

said at least one common electrode including (a) a plurality of first electrically conductive portions each of which at least partly overlaps a corresponding one of the pressure chambers, and is elongate in the second direction, (b) a plurality of non-conductive areas each of which is not electrically conductive and which are alternate with the first conductive portions in the first direction, and (c) at least one second electrically conductive portion which extends in the first direction to connect respective one ends of the first conductive portions to each other.

26. The printer head according to claim 25, wherein said at least one common electrode includes two said electrically conductive portions one of which extends in the first direction to connect the respective one ends of the first conductive portions and the other of which extends in the first direction to connect the respective other ends of the first conductive portions.

27. The printer head according to claim 25, wherein said at least one common electrode is provided on one of opposite planar surfaces of said at least one piezoelectric sheet, such that said at least one common electrode is elongate in the first direction and has a first edge line parallel to the first direction, and wherein the piezoelectric actuator further comprises a plurality of first internal leads which extend through a thickness of said at least one piezoelectric sheet; and a plurality of first internal pads which are electrically connected to the individual electrodes via the first internal leads, respectively, and are provided on said one planar surface of said at least one piezoelectric sheet, such that each of the first internal pads is distant from the first edge line of said at least one common electrode by a first predetermined distance in the second direction.

28. The ink jet printer head according to claim 27, wherein the sheet members further comprises an outer sheet member which is stacked on said at least one piezoelectric sheet, and wherein the piezoelectric actuator further comprises a common electrical conductor which has a shape substantially identical with a shape of said at least one common electrode, is electrically connected to said at least one common electrode, and is provided on one of opposite planar surfaces of the outer sheet member, such that the common electrical conductor is elongate in the first direction and has a second edge line parallel to the first direction; a plurality of second internal leads which extend through a thickness of the outer sheet member; and a plurality of second internal pads which are electrically connected to the first internal pads via the second internal leads, respectively, and which are provided on said one planar surface of the outer sheet member, such that each of the second internal pads is distant from the second edge line of the common electrical conductor by a second predetermined distance in the second direction.

29. The ink jet printer head according to claim 28, further comprises at least one third internal lead which extends through a thickness of the outer sheet member and which electrically connects between the common electrical conductor and said at least one common electrode.

30. The ink jet printer head according to claim 28, wherein the nozzles of the cavity unit are arranged in a plurality of arrays which are distant from each other by a third predetermined distance in the second direction, and the pressure chambers are arranged in a plurality of arrays which are distant from each other by a fourth predetermined distance in the second direction, wherein said at least one common electrode has two said first edge lines which extend in the first direction and are distant from each other in the second direction, and the first internal pads are provided in an area between the two first edge lines, and wherein the common electrical conductor has two said second edge lines which extend in the first direction and are distant from each other in the second direction, and the second internal pads are provided in an area between the two second edge lines.

31. The ink jet printer head according to claim 25, wherein the nozzles of the cavity unit are arranged in four arrays, and wherein the active portions of the piezoelectric actuator are arranged in four arrays respectively corresponding to the four arrays in which the nozzles are arranged.

32. An ink jet printer head, comprising:

a cavity unit having a plurality of nozzles arranged in a first direction, a plurality of pressure chambers which communicate with the nozzles, respectively, and a plurality of partition walls which separate the pressure chambers from each other and each of which extends in a second direction perpendicular to the first direction;

a piezoelectric actuator having a plurality of active portions each of which is driven to change a pressure of an ink accommodated in a corresponding one of the pressure chambers, and thereby eject, from a corresponding one of the nozzles, a droplet of the ink, the cavity unit and the piezoelectric actuator being fixed to each other;

the piezoelectric actuator comprising a plurality of sheet members which are stacked on each other and include at least one piezoelectric sheet; at least one common electrode; and at least one individual-electrode layer including a plurality of individual electrodes which are aligned with the pressure chambers, respectively, and each of which cooperates with a corresponding one of a plurality of portions of said at least one common electrode to sandwich a corresponding one of a plurality of portions of said at least one piezoelectric sheet, in a direction of stacking of the sheet members, and thereby provide a corresponding one of the active portions of the piezoelectric actuator;

said at least one common electrode being provided on one of opposite planar surfaces of said at least one piezoelectric sheet, such that said at least one common electrode is elongate in the first direction and has a first edge line parallel to the first direction;

the piezoelectric actuator further comprising a plurality of first internal leads which extend through a thickness of said at least one piezoelectric sheet; and a plurality of internal pads which are electrically connected to the individual electrodes via the first internal leads, respectively, and which are provided on said one planar surface of said at least one piezoelectric sheet, such that each of the internal pads is distant from the first edge line of said at least one common electrode by a first predetermined distance in the second direction, and extends in a third direction inclined by a first predetermined angle relative to the second direction;

the piezoelectric actuator further comprising a plurality of external pads which are provided on an outer surface of an outermost sheet member of the sheet members and are electrically connected to a cable member; and each of the individual electrodes including an end portion which extends in a fourth direction inclined by a second predetermined angle relative to the second direction, the end portion of said each individual electrode being connected to a corresponding one of the external pads via a corresponding one of the first internal leads and a corresponding one of the internal pads.

33. The ink jet printer head according to claim 32, wherein the third and fourth directions are parallel to each other.

34. The ink jet printer head according to claim 32, wherein the external pads are located, on the outer surface of the outermost sheet member of the piezoelectric actuator, at respective positions that are at least partially aligned with the partition walls each of which is located between corresponding two pressure chambers of the plurality of pressure chambers in said reference direction, wherein the piezoelectric actuator further comprising a plurality of second internal leads which extend through a thickness of the outermost sheet member and electrically connect between the internal pads and the external pads, respectively, and wherein the end portion of said each individual electrode is connected to a corresponding one of the external pads via a corresponding one of the first internal leads, a corresponding one of the internal pads, and a corresponding one of the second internal leads.

35. The printer head according to claim 32, wherein said each of the individual electrodes includes a straight portion which is connected to the end portion thereof and which extends parallel to a corresponding one of the pressure chambers in the second direction and is aligned with said one pressure chamber.

36. An ink jet printer head, comprising:

a cavity unit having a plurality of nozzles arranged in a first direction, and a plurality of pressure chambers which communicate with the nozzles, respectively, and which are grouped into at least two groups of pressure chambers each group of which consists of at least two pressure chambers arranged in the first direction;

a piezoelectric actuator having a plurality of active portions each of which is driven to change a pressure of an ink accommodated in a corresponding one of the pressure chambers, and thereby eject, from a corresponding one of the nozzles, a droplet of the ink, the cavity unit and the piezoelectric actuator being fixed to each other;

the piezoelectric actuator comprising at least two actuator portions each of which has a plurality of active portions and which are arranged next to each other in the first direction such that respective one ends of said at least two actuator portions are opposed to each other in the first direction, and such that said at least two actuator portions are opposed to said at least two groups of pressure chambers, respectively;

said each of said at least two actuator portions comprising a plurality of sheet members which are stacked on each other and include at least one piezoelectric sheet; at least one common electrode; and at least one individual-electrode layer including a plurality of individual electrodes which are aligned with said at least two pressure chambers of a corresponding one of said at least two groups of pressure chambers, respectively, and each of which cooperates with a corresponding one of a plurality of portions of said at least one common electrode to sandwich a corresponding one of a plurality of portions of said at least one piezoelectric sheet, in a direction of stacking of the sheet members, and thereby provide a corresponding one of the active portions of said each actuator portion;

said at least one common electrode being provided on one of opposite planar surfaces of said at least one piezoelectric sheet, such that said at least one common electrode is elongate in the first direction and has a first edge line parallel to the first direction;

said each actuator portion further comprising a plurality of internal leads which extend through a thickness of said at least one piezoelectric sheet; and a plurality of internal pads which are electrically connected to the individual electrodes via the internal leads, respectively, and which are provided on said one planar surface of said at least one piezoelectric sheet, such that each of the internal pads is distant from the first edge line of said at least one common electrode by a first predetermined distance in a second direction perpendicular to the first direction, and extends in a third direction inclined by a first predetermined angle relative to the second direction;

said each of said at least two actuator portions further comprising a plurality of external pads which are provided on an outer surface of an outermost sheet member of the sheet members, such that the external pads are arranged in the first direction, and are electrically connected to a flat cable;

each of the individual electrodes of said each actuator portion including an end portion which is inclined in a direction away from said one end of said each actuator portion; and the end portion of said each individual electrode being connected to a corresponding one of the external pads via a corresponding one of the internal leads and a corresponding one of the internal pads.

37. The ink jet printer head according to claim 36, wherein the end portion of said each individual electrode extends in a fourth direction inclined by a second predetermined angle relative to the second direction in which the partition walls of the cavity unit extend.

38. The ink jet printer head according to claim 37, wherein the external pads are located, on the outer surface of the outermost sheet member of the piezoelectric actuator, at respective positions that are at least partially aligned with the partition walls each of which is located between corresponding two pressure chambers of the plurality of pressure chambers in the first direction.

39. The ink jet printer head according to claim 36, wherein said at least one common electrode includes a plurality of first electrically conductive portions each of which at least partly overlaps a corresponding one of the pressure chambers, and is elongate in the second direction, and additionally includes at least one second electrically conductive portion which extends in the first direction to connect respective one ends of the first conductive portions.

40. The ink jet printer head according to claim 36, wherein said each of the individual electrodes includes a straight portion which is connected to the end portion thereof and which extends parallel to a corresponding one of the pressure chambers in the second direction and is aligned with said one pressure chamber.

* * * * *